US007346293B2

(12) United States Patent
Suzuki et al.

(10) Patent No.: US 7,346,293 B2
(45) Date of Patent: Mar. 18, 2008

(54) PROCESS CARTRIDGE HAVING LIGHT GUIDES AND MEMORY MEMBER, AND ELECTROPHOTOGRAPHIC IMAGE FORMING APPARATUS TO WHICH SUCH CARTRIDGE IS MOUNTABLE

(75) Inventors: Tatsuya Suzuki, Shizuoka-Ken (JP); Nobuharu Hoshi, Shizuoka-Ken (JP); Kazunari Murayama, Shizuoka-Ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/566,878

(22) Filed: Dec. 5, 2006

(65) Prior Publication Data

US 2007/0092286 A1 Apr. 26, 2007

Related U.S. Application Data

(62) Division of application No. 10/878,610, filed on Jun. 29, 2004, now Pat. No. 7,162,174.

(30) Foreign Application Priority Data

Oct. 8, 2003 (JP) ..... 2003/349466
Nov. 28, 2003 (JP) ..... 2003/398939
May 31, 2004 (JP) ..... 2004/161219

(51) Int. Cl.
*G03G 21/16* (2006.01)

(52) U.S. Cl. ..... 399/111

(58) Field of Classification Search ..... 399/27, 399/28, 61, 64, 107, 110, 111, 112, 90
See application file for complete search history.

(56) References Cited

U.S. PATENT DOCUMENTS 4,544,260 A * 10/1985 Kolbe ..... 399/111
5,521,684 A 5/1996 Koji ..... 399/64
5,734,949 A * 3/1998 Goto et al. ..... 399/111
5,937,239 A 8/1999 Watanabe et al. ..... 399/11
6,011,941 A * 1/2000 Takashima et al. ..... 399/111
6,081,676 A 6/2000 Inomata ..... 399/25
6,097,906 A * 8/2000 Matsuzaki et al. ..... 399/111 X
6,173,130 B1 1/2001 Oguma ..... 399/27
6,289,189 B1 9/2001 Numagami et al. ..... 399/111

(Continued)

FOREIGN PATENT DOCUMENTS

JP 10-186822 7/1998

OTHER PUBLICATIONS

European Search Report for European Application No. 04015342.1 issued Apr. 11, 2007.

*Primary Examiner*—Sandra L. Brase
(74) *Attorney, Agent, or Firm*—Fitzpatrick, Cella, Harper & Scinto

(57) ABSTRACT

A cartridge is detachably mountable to an electrophotographic-image-forming-apparatus main assembly including light emitting and receiving portions. The cartridge includes an electrophotographic photosensitive drum, a developing member, a driving force receiving portion, first and second rotatably connected frames, the first supporting the drum and having a memory, and the second supporting the developing member and having a developer accommodating portion, a main-assembly-contactable electrical contact, first and second light guides whose respective entrance and exit are opposable to the emitting and receiving portions, respectively, first and second cartridge positioning portions engageable with first and second main assembly positioning portions, and a cartridge limiting portion abutting a main assembly regulating portion to limit rotation of the cartridge which otherwise occur about the cartridge positioning portions when the driving force receiving portion receives a driving force from the main assembly.

10 Claims, 17 Drawing Sheets

U.S. PATENT DOCUMENTS 6,404,996 B1 6/2002 Mori et al. ..... 299/27 X
6,442,359 B1 8/2002 Numagami et al. ..... 399/111
6,463,233 B2 10/2002 Kojima et al. ..... 399/111
6,505,007 B2 1/2003 Miura et al. ..... 399/27
6,553,189 B2 4/2003 Miyamoto et al. ..... 399/27
6,577,831 B1 6/2003 Kojima et al. ..... 399/111
6,608,980 B2 8/2003 Murayama et al. ..... 399/111
6,681,088 B2 1/2004 Kanno et al. ..... 399/111
6,876,826 B2 * 4/2005 Noda et al. ..... 399/111 X
6,980,758 B2 12/2005 Murayama et al. ..... 399/111
7,072,594 B2 7/2006 Hoshi et al. ..... 399/27
7,127,194 B2 10/2006 Hoshi et al. ..... 399/111
2002/0085854 A1 7/2002 Numagami et al. ..... 399/90
2002/0141788 A1 10/2002 Matsuda et al. ..... 399/260
2003/0049036 A1 3/2003 Ueno et al. ..... 399/25
2003/0086715 A1 5/2003 Koji et al. ..... 399/27
2003/0133723 A1 7/2003 Fujita et al. ..... 399/111
2003/0156848 A1 8/2003 Kawai et al. ..... 399/27

* cited by examiner

PROCESS CARTRIDGE HAVING LIGHT GUIDES AND MEMORY MEMBER, AND ELECTROPHOTOGRAPHIC IMAGE FORMING APPARATUS TO WHICH SUCH CARTRIDGE IS MOUNTABLE

CROSS-REFERENCE TO RELATED APPLICATION

The present application is a Divisional application of U.S. application Ser. No. 10/878,610 filed Jun. 29, 2004, now allowed.

FIELD OF THE INVENTION AND RELATED ART

The present invention relates to a process cartridge, and an electrophotographic image forming apparatus in which a process cartridge is removably mountable.

Here, an electrophotographic image forming apparatus is an apparatus for forming an image on a recording medium (for example, recording paper, OHP sheet, etc.), with the use of an electrophotographic image forming method. As examples of an electrophotographic image forming apparatus, there are an electrophotographic copying machine, an electrophotographic printer (for example, a laser printer, an LED printer, etc.), a facsimile machine, a word processor, a multifunction apparatus capable of performing the tasks of two or more of the preceding machines (multifunction printer, etc.), etc.

A process cartridge (which hereinafter will be referred to simply as a "cartridge") is a cartridge which is removably mountable in the main assembly of an electrophotographic image forming apparatus, and in which a minimum of a developing means (developing member) and an electrophotographic photosensitive drum are integrally placed.

It has been a common practice to employ the combination of a developing apparatus and developer to develop an electrostatic latent image formed on an electrophotographic photosensitive drum (which hereinafter will be referred to simply as a "photosensitive drum") of an electrophotographic image forming apparatus (which hereinafter will be referred to as an "image forming apparatus").

An image forming apparatus which employs a process cartridge can be maintained by an operator alone. In other words, the employment of a cartridge system can drastically improve an image forming apparatus in operational efficiency.

As the technologies for making an image forming apparatus easier to use, various developer remainder detecting means capable of informing an operator of the amount of the developer remaining in the developer storage portion of a cartridge have been devised. Some of these developer remainder detecting means detect the amount of the developer remaining in the developer storage portion, by measuring the length of time a beam of light is allowed to travel through the developer storage portion of the cartridge during a predetermined length of time.

A developer remainder detecting means (which hereinafter will be referred to simply as a "remainder detecting means") of a transmission type such as the aforementioned ones, comprises, for example: the combination of a beam emitting portion and a beam receiving portion, disposed on the main assembly side of an image forming apparatus; a beam transmitting portion with which the developer storage portion is provided; and a beam guide for guiding a beam of light emitted from the beam emitting portion, from the beam emitting portion to the beam transmitting portion, and then, to the beam receiving portion.

In the case of a developer remainder detecting means structured as described above, the length of time the detection beam is allowed to travel through the developer storage portion is dependent upon the amount of the developer remaining therein. In other words, the greater the amount of the remaining developer, the shorter the time; the smaller the amount of the remaining developer, the longer the time. Therefore, it is possible to estimate the amount of the developer remaining in the developer storage portion, by measuring the length of time the detection beam is allowed to travel through the developer storage portion, with the use of a measuring means on the main assembly side of the image forming apparatus (Japanese Laid-open Patent Application 10-186822).

As the technologies of another type for making it easier for an operator to use an image forming apparatus of a cartridge type, various methods for providing a cartridge with a storage element (storage member) have been devised. Between this storage element and the apparatus main assembly, information regarding image quality, the cartridge itself (manufacture, length of service life (for example, amount of remaining developer), the operational state of the apparatus main assembly, etc.) are exchanged, making it easier to maintain the image forming apparatus, or the cartridge (U.S. Pat. No. 5,937,239).

In recent years, demand has been increasing for an image forming apparatus which is not only easier to use, but also, smaller. In order to reduce an image forming apparatus in size, it is necessary to create a cartridge smaller in the space it occupies in the main assembly of an image forming apparatus. In the case of a color image forming apparatus, this need for cartridge size reduction is a very serious issue.

The issue of cartridge size reduction is just as important to a cartridge comprising the above-described developer remainder amount detecting means and storage element for making it easier for an operator to use a cartridge, and an image forming apparatus employing such a cartridge, as it is to a color image forming apparatus.

SUMMARY OF THE INVENTION

The primary object of the present invention is to provide a process cartridge substantially smaller than a process cartridge in accordance with the prior art, and an electrophotographic image forming apparatus in which said process cartridge is removably mountable.

Another object of the present invention is to provide a process cartridge which is substantially smaller than a process cartridge in accordance with the prior art, and in which a storage member is positioned between the point of its first light guide through which the beam of detection light enters the first light guide, and the point of its second light guide through which the beam of detection light exits from the second light guide, and an electrophotographic image forming apparatus in which the process cartridge is removably mountable.

Another object of the present invention is to provide an electrophotographic image forming apparatus, in which the beam emitting portion, beam receiving portion for receiving the detection beam emitted from the beam emitting portion, and electrical contacts on the main assembly side, are compactly disposed on the same substrate, and a process cartridge removably mountable in the electrophotographic image forming apparatus.

Another object of the present invention is to provide a process cartridge which is removably mountable in the main assembly of an electrophotographic image forming apparatus, in which the beam emitting portion, the beam receiving portion for receiving the detection beam emitted from the beam emitting portion, and electrical contacts on the main assembly side, are compactly disposed on the same substrate, comprising: an electrophotographic photosensitive drum; a developing member for developing an electrostatic latent image formed on the photosensitive drum; a frame having a developer storage portion for storing the developer used by the developing member to develop the electrostatic latent image; a first beam guide which is located at one end of the frame in terms of a direction parallel to the axial line of the electrophotographic photosensitive drum, and at the front end of the process cartridge, in terms of the direction in which the process cartridge is inserted into the main assembly of an electrophotographic image forming apparatus, and which has a beam entrance portion which is positioned directly opposite to the beam emitting portion, and through which the detection beam emitted from the beam emitting portion is guided into the developer storage portion so that the detection beam travels through the internal space of the developer storage portion, when the process cartridge is in the main assembly of the image forming apparatus; a second beam guide which is located at the same end of the frame, in terms of the direction parallel to the axial line of the electrophotographic photosensitive drum, as the end of the frame at which the first beam guide is located, and at the front end of the process cartridge, in terms of the direction in which the process cartridge is inserted into the main assembly of an electrophotographic image forming apparatus, and which has a beam exit portion which is positioned directly opposite to the beam receiving portion, and through which the detection beam having traveled through the internal space of the developer storage portion is guided toward the beam receiving portion, when the process cartridge is in the main assembly of the image forming apparatus; a storage member which is located at the same end of the frame, in terms of the direction parallel to the axial line of the electrophotographic photosensitive drum, as the end of the frame at which the first and second beam guides are located, and at the front end of the frame, in terms of the direction in which the process cartridge is inserted into the main assembly of the image forming apparatus, is enable to communicate with the main assembly of the image forming apparatus, and is located so that it is positioned between a horizontal plane coinciding with the center of the beam entrance portion, and a horizontal plane coinciding with the center of the beam exit portion, when the process cartridge is in the main assembly of the image forming apparatus. It is also an object of the present invention to provide an electrophotographic image forming apparatus in which such a process cartridge is removably mountable.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, some of the preferred embodiments of the present invention will be described with reference to the appended drawings. Incidentally, the materials and shapes of the structural components, and the positional relations among them, which come up in the following descriptions of the preferred embodiment of the present invention, are not intended to limit the scope of the present invention, unless specifically noted. Further, if a component similar to a given component which came up in the description of one of the preceding embodiments comes up in the descriptions of the following embodiments, it is similar in material and shape to those in the preceding embodiments, unless specifically noted.

Referring to FIGS. 1-15, the cartridge and image forming apparatus, in accordance with the present invention, will be described.

[Description of Image Forming Apparatus]

Figure 2:
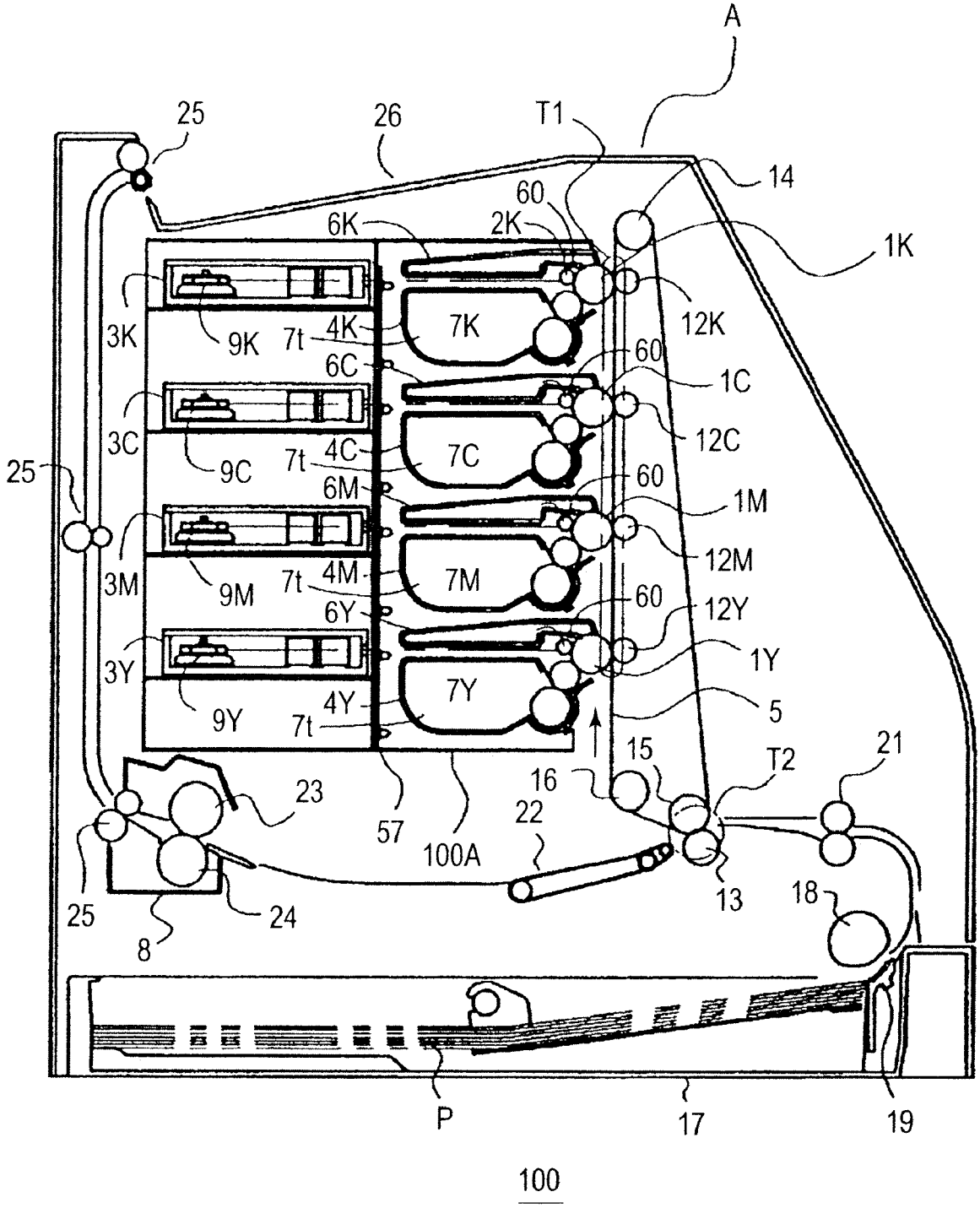
FIG. 2 is a schematic sectional view of a color laser printer, in the preferred embodiment, which is an example of an image forming apparatus employing one of the electrophotographic processes.

First, referring to FIG. 2, the general structure of a color image forming apparatus will be described. FIG. 2 is a schematic sectional view of a color laser printer, which is an example of an image forming apparatus, in accordance with the present invention, employing one of the electrophotographic processes.

As shown in FIG. 2, the color laser printer 100 (which hereinafter may be referred to simply as the "printer") has a cartridge compartment section 100A comprising a plurality of cartridge compartments in which a yellow cartridge (7Y) containing developer of yellow color (Y), a magenta cartridge (7M) containing developer of magenta color (M), a cyan cartridge (7C) containing developer of cyan color (C), and a black cartridge (7K) containing developer of black color (K), are removably mountable, one for one. The color laser printer 100 also has an intermediary transferring member 5, which holds a plurality of developer images different in color after the developer images developed by the cartridges 7 in the cartridge compartment section 100A are transferred in layers onto the intermediary transferring member 5, and from which the color images are transferred onto a recording medium P delivered from a recording medium feeding section.

The electrophotographic photosensitive drum 1 (1Y 1M, 1C, or 1K, which hereinafter may be referred to simply as the "photosensitive drum") is rotationally driven by a driving means (unshown) in the counterclockwise direction indicated by an arrow mark in FIG. 2.

Located around the peripheral surface of the photosensitive drum 1 are a charge roller 2, for example, charge roller 2K as a charging member for uniformly charging the peripheral surface of the photosensitive drum 1, and scanner units (3Y, 3M, 3C, and 3K) for projecting a beam of laser light, while modulating it with image formation data, in order to form an electrostatic latent image, on the peripheral surface of the photosensitive drum 1 charged by the charge roller 2. In terms of the rotational direction of the photosensitive drum 1, the charge roller 2 is on the upstream side of the scanner units. Also located around the peripheral surface of the photosensitive drum 1 are: a second frame 4 (4Y, 4M, 4C, and 4K) which holds a developing means for developing the latent image; primary transfer rollers (12Y, 12M, 12C, and 12K) for transferring the developer image on the peripheral surface of the photosensitive drum 1, onto the intermediary transferring member 5, in the primary transfer station T1; and a first frame 6 (6Y, 6M, 6C, and 6K) holding a cleaning blade 60 for removing the developer remaining on the peripheral surface of the photosensitive drum 1 after the transfer of the developer image. The transfer rollers are on the main assembly A side of the image forming apparatus.

After being transferred onto the intermediary transferring member 5, the developer images are transferred by a secondary transfer roller 13 onto the recording or transfer medium P, in the second transfer station T2. Then, the transfer medium P is conveyed through a fixing device 8, in which the developer images on the recording medium P are fixed to the recording medium P. Then, the recording medium P is discharged by a pair of discharge rollers 25 onto the delivery tray 26, which constitutes a part of the top surface of the apparatus main assembly.

The cartridge 7 comprises the above-described photosensitive drum 1, the charging member 2, the second frame 4, and the first frame 6. The printer 100 has a hinged cover 11 (FIG. 6) to which the intermediary transferring member 5 is attached. With the cover 11 opened, the cartridge 7 is mounted into, or removed from, the printer 100, from the photosensitive drum side thereof.

Figure 1:
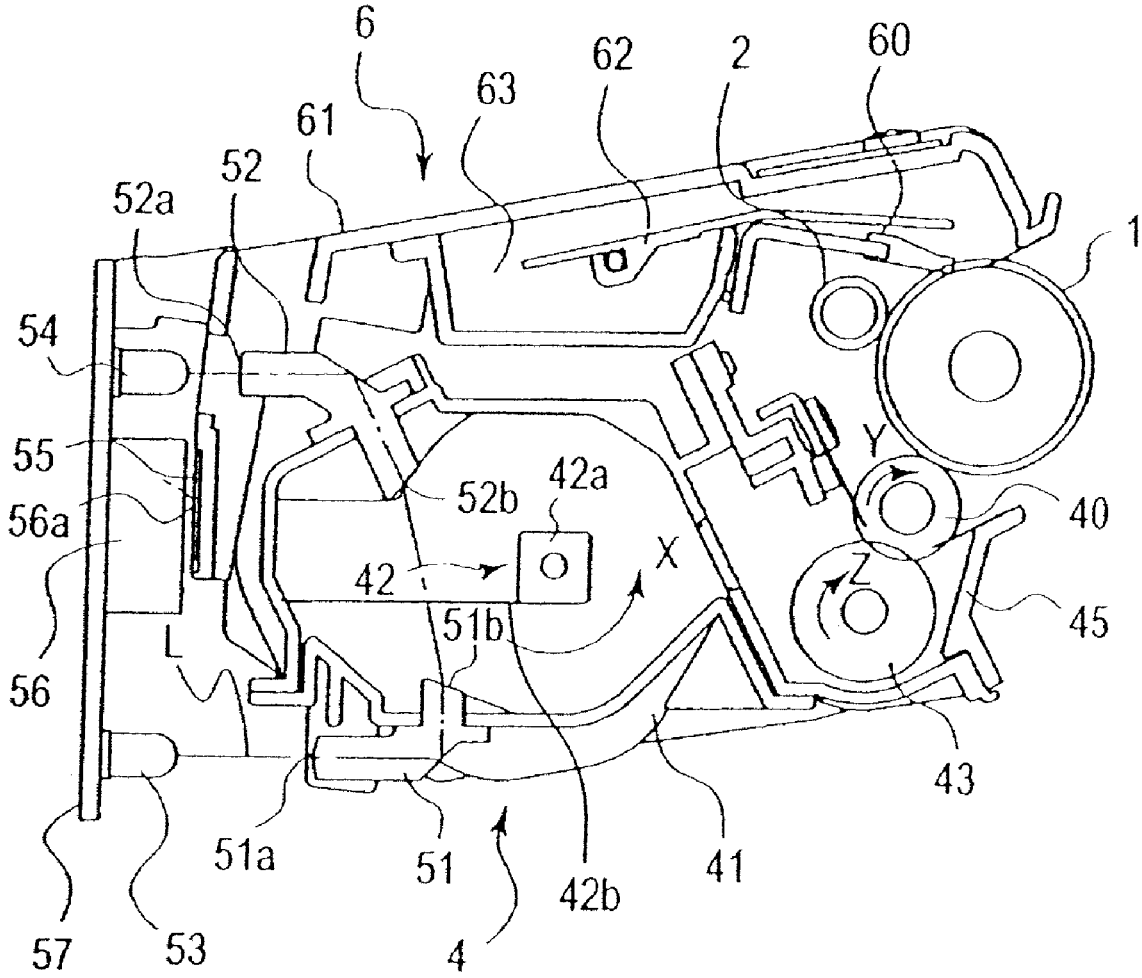
FIG. 1 is a sectional view of the process cartridge in a preferred embodiment of the present invention.

Next, referring to FIGS. 1-3, various portions of the printer 100 and the cartridge 7 will be described.

Figure 3:
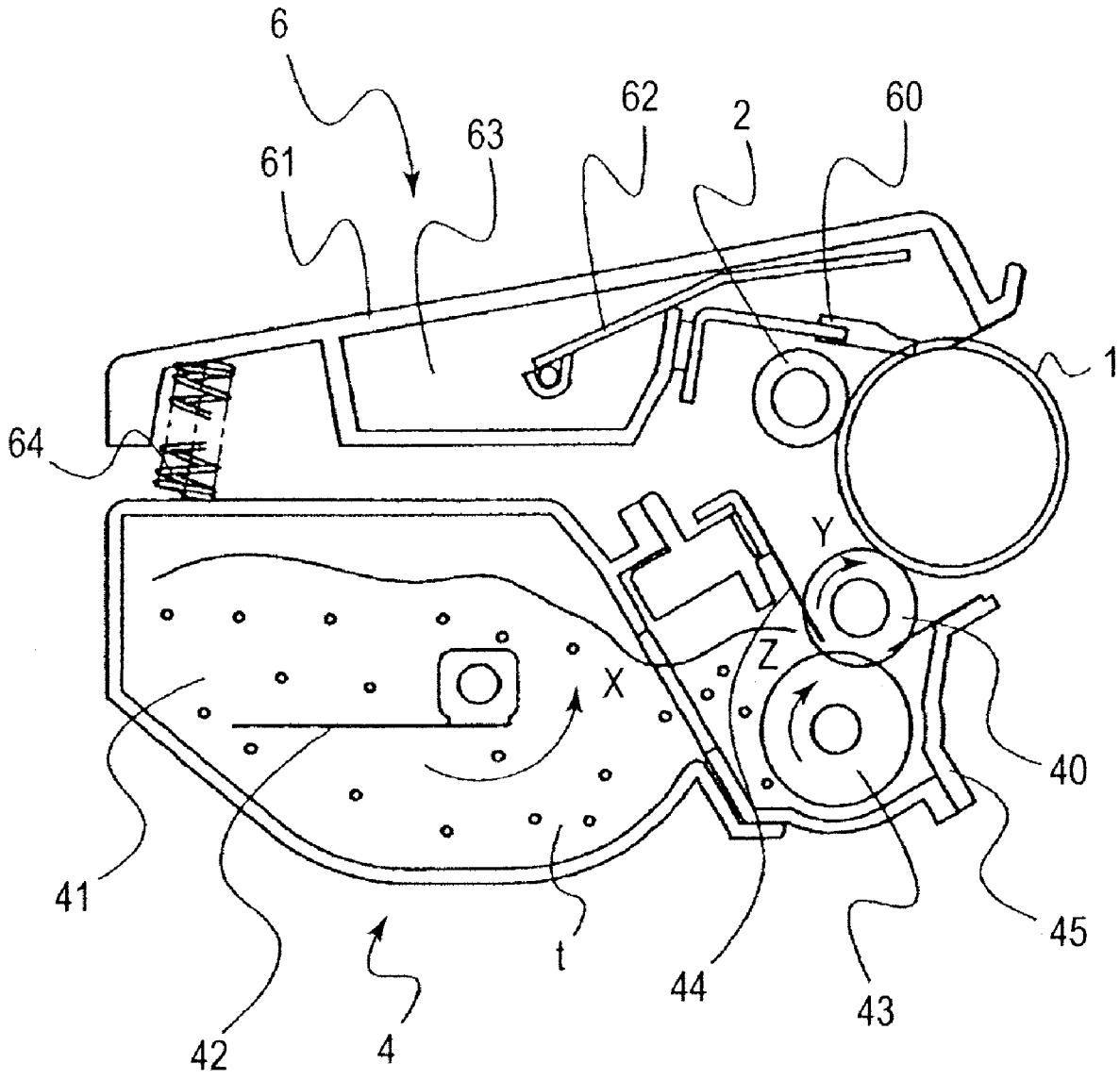
FIG. 3 is a sectional view of the process cartridge, depicting the general structure thereof.

FIG. 3 is a sectional view of the cartridge 7, depicting the structure thereof. Here, only the cartridge 7 containing the yellow developer will be described, since all the cartridges 7 different in the color of the developers they contain are the same in structure; the cartridges 7 containing the developer different in color from yellow developer will not be described.

First, the various portions of the cartridge 7 containing the yellow developer will be described.

[Photosensitive Drum]

The photosensitive drum 1 (1Y) comprises a substrate, for example, an aluminum cylinder, and a layer of organic photoconductive substance (OPC) coated on the peripheral surface of the substrate. The photosensitive drum 1 is rotatably supported at its lengthwise end portions, by a pair of supporting members, which are supported by the first frame 6.

[Charging Member]

The charge roller 2 is a charging member based on one of the contact charging systems. It is an electrically conductive roller, to which charge bias is applied while it is placed in contact with the peripheral surface of the photosensitive drum 1. With the application of the charge bias, the peripheral surface of the photosensitive drum 1 is uniformly charged. The charge roller 2 also is supported by the first frame 6.

[Second Frame]

Referring to FIG. 3, the second frame 4 (4Y) has a developer storage portion 41 in which the developer of yellow color for developing the aforementioned latent image into a visible image is stored. It holds a development roller 40 as a latent image developing member, a developer conveying member 42, a developer supplying roller 43, and a development blade 44. In other words, the second frame 4 supports the development roller 40, and has the developer storage portion 41 in which the developer t used for the development of the latent image is stored. The second frame 4 is connected to the first frame 6 so that they can pivot relative to each other.

The developer in the developer storage portion 41 is sent to the developer supplying roller 43 by rotating the developer conveying member 42 in the counterclockwise direction (indicated by arrow mark X in FIG. 3); the developer supplying roller 43 is a member for supplying the development roller 40 with the developer. As the development roller 40 (FIG. 3) is rotated in the clockwise direction (indicated by arrow Y in FIG. 3), the developer is coated on the peripheral surface of the development roller 40 by the supply roller 43, and the development blade 44 is kept pressed on the peripheral surface of the development roller 40. The supply roller 43 is an elastic roller comprising a metallic core, and a spongy layer formed around the peripheral surface of the metallic core.

As development bias is applied to the development roller 40, a visible image, which reflects the pattern of the electrostatic latent image, is formed of the developer, on the peripheral surface of the photosensitive drum 1. In other words, the development roller 40 develops the electrostatic latent image formed on the peripheral surface of the photosensitive drum 1.

Next, the various portions of the main assembly A of the image forming apparatus will be described.

[Exposing Means]

The scanner unit as an exposing means comprises a laser diode (unshown), to which image formation signals are given. As the image formation signals are given to the laser diode, the laser diode emits a beam of image formation light which reflects the image formation signals, onto one of the polygon mirrors (9Y, 9M, 9C, and 9K), which are being rotated at a high velocity by a scanner motor (unshown). As a result, the beam of image formation light is deflected by one of the mirrors (9Y, 9M, 9C, and 9K) toward a focal lens (unshown), and is transmitted through the focal lens, being thereby focused on the peripheral surface of the photosensitive drum 1, which is being rotated at a predetermined constant peripheral velocity. As a result, the numerous points of the peripheral surface of the photosensitive drum 1 are selectively exposed, forming thereby an electrostatic latent image, on the peripheral surface of the photosensitive drum 1.

[Intermediary Transferring Member]

The intermediary transferring member 5 is a member onto which a plurality of images formed of the developer, on the peripheral surfaces of the photosensitive drums 1, by the development rollers 40, one for one, are transferred in layers during the color image formation process. The intermediary transferring member 5 is circularly rotated in the clockwise direction (FIG. 2) at the same peripheral velocity as those of the photosensitive drums 1.

The images formed of the developer (which hereinafter will be referred to as the developer image), on the photosensitive drums 1, are transferred in layers onto the intermediary transferring member 5, in the primary transfer stations T1, by the primary transfer rollers (12Y, 12M, 12C, and 12K) which are kept pressed against the peripheral surfaces of the photosensitive drums 1, with the intermediary transferring member 5 kept pinched between the transfer rollers and photosensitive drums 1, and to which voltage is being applied. The primary transfer stations T1 are where the peripheral surfaces of the primary transfer rollers are kept pressed against the peripheral surface of the photosensitive drums 1, with the intermediary transferring member 5 kept pinched between the two surfaces.

After the multilayer transfer of the developer images, the intermediary transferring member 5 is moved through the secondary transfer station T2, through which the recording medium P is conveyed while remaining pinched between the secondary transfer roller 13 to which voltage is being applied, and the intermediary transferring member 5, so that the developer images on the intermediary transferring member 5 are transferred all at once onto the recording medium P.

The intermediary transferring member 5 in accordance with the present invention is an endless and seamless belt formed of resin. It is stretched around a driving roller 14, a counter roller 15, and a tension roller 16, being thereby supported by the three rollers.

Further, the intermediary transferring member 5 is attached to the apparatus main assembly A at the driving roller 14. As the driving force is transmitted to one of the lengthwise ends of the driving roller 14 from a motor (unshown) in coordination with an image forming operation, the driving roller 14 is rotated in the clockwise direction indicated in the drawing.

[Sheet Conveying Portion]

The sheet conveying portion is a portion for conveying a recording medium P to the photosensitive drum 1. It comprises a cassette 17 storing multiple recording media P, a feed roller 18, a separation pad 19, and a pair of registration rollers 21.

During an image forming operation, the roller 18 is rotationally driven in synchronism with the image forming operation, feeding the recording media P in the cassette 17, out into the apparatus main assembly A, one by one. Each recording medium P is conveyed to the pair of registration rollers 21 by way of the sheet conveying rollers (unshown). The pair of registration rollers 21 carries out a non-rotational operation which keeps the recording medium P on standby, and a rotational operation which releases the recording medium P toward the intermediary transferring member 5, following a predetermined sequence, in order to align the developer images with the recording medium P, for the transfer process.

[Transfer Station]

The transfer station comprises the secondary transfer roller 13, which is movable roughly in the vertical direction; it is moved by a cam (unshown), with the timing for transferring the developer images, to the top position in which it transfers the developer images onto the recording medium P, that is, the position in which it is kept pressed against the intermediary transferring member 5, with the recording medium P kept pinched between the transfer roller 13 and intermediary transferring member 5. While the transfer roller 13 is kept pressed against the intermediary transferring member 5, bias is continuously applied to the transfer roller 13. As a result, the developer images on the intermediary transferring member 5 are transferred onto the recording medium P.

The intermediary transferring member 5 and the transfer roller 13 are individually driven. Therefore, the recording medium P is conveyed in the leftward direction, in FIG. 2, at a predetermined speed, while remaining pinched between the intermediary transferring member 5 and transfer roller 13. Then, the recording medium P is further conveyed by the conveyer belt 22 toward the fixation station. [Fixation Station]

The fixing device 8 fixes the developer images which have just been transferred onto the recording medium P from the intermediary transferring member 5. To describe in more detail, the fixing device 8 comprises: a film guide unit 23 containing a ceramic heater for heating the recording medium P, and a pressure roller 24 for keeping the recording medium P pressed against the film guide unit 23. In other words, heat and pressure are applied to the recording medium P bearing the developer images, while the recording medium P is conveyed by the film guide unit 23 and the pressure roller 24. As a result, the developer images on the recording medium P are fixed to the recording medium P.

[Image Forming Operation]

Next, the image forming operation carried out by the apparatus structured as described above will be described.

First, the roller 18 (FIG. 2) is rotated to separate one of the recording media P in the cassette 17 from the rest, and conveys it to the pair of registration rollers 21.

Meanwhile, the photosensitive drum 1 and the intermediary transferring member 5 are rotated at a predetermined peripheral velocity (which hereinafter may be referred to as process speed) in the direction indicated by an arrow mark in FIG. 2.

After the peripheral surface of the photosensitive drum 1 is uniformly charged by the charge roller 2, it is exposed to the aforementioned beam of exposure light. As a result, a latent image is formed on the peripheral surface of the photosensitive drum 1. Since all the cartridges are the same in terms of their image forming operation, only the operation for forming an image of yellow color will be described, here.

[Formation of Yellow Image]

An electrostatic image which reflects the yellow component of an intended color image is formed on the peripheral surface of the photosensitive drum 1Y by projecting a beam of laser light emitted from the scanner unit 3Y which corresponds to the yellow component of the intended image. In synchronism with the formation of the latent image, the developing means held in the second frame 4Y is made to operate to adhere the yellow developer to the peripheral surface of the photosensitive drum 1, in the pattern of the latent image; the developing means is operated to develop the latent image. The developer image formed on the peripheral surface of the photosensitive drum 1Y is transferred onto the outwardly facing surface of the intermediary transferring member 5, by applying to the intermediary transferring member 5, a voltage opposite in polarity to the yellow developer, in the transfer station T1 located on the downstream side of the development station.

Next, the latent images reflecting the magenta, cyan, and black components of the intended color image, are formed and are developed into the magenta, cyan, and black developer images, in the mentioned order. Then, the magenta, cyan, and, black developer images are sequentially transferred onto the intermediary transferring member 5. As a result, a full color image is formed of four developer images, that is, the yellow, magenta, cyan, and black developer images, on the intermediary transferring member 5.

Before the leading edge of the full-color image formed on the intermediary transferring member 5 reaches the secondary transfer station T2, the recording medium P kept on standby by the aforementioned pair of registration rollers 21 is released so that the leading end of the recording medium P will arrive at the secondary transfer station T2 at the same time as the leading edge of the full-color image.

The transfer roller 13 kept on standby below the counter roller 15, that is, in the aforementioned bottom position, while the aforementioned four developer images different in color are formed, is moved upward into the aforementioned top position by the cam (unshown), pressing thereby the recording medium P upon the intermediary transferring member 5, in the transfer station T2. Then, a bias opposite in polarity from the developer is applied to the transfer roller 13. As a result, the four developer images, which make up the single full-color image, are transferred all at once onto the recording medium P.

After being conveyed through the transfer station T2, the recording medium P is conveyed to the fixing apparatus 8, in which the developer images are fixed. Thereafter, the recording medium P is discharged by the pair of discharge rollers 25 onto the delivery tray 26 on top of the apparatus main assembly A, concluding the printing of a single copy.

[Process Cartridge Structure]

Figure 4:
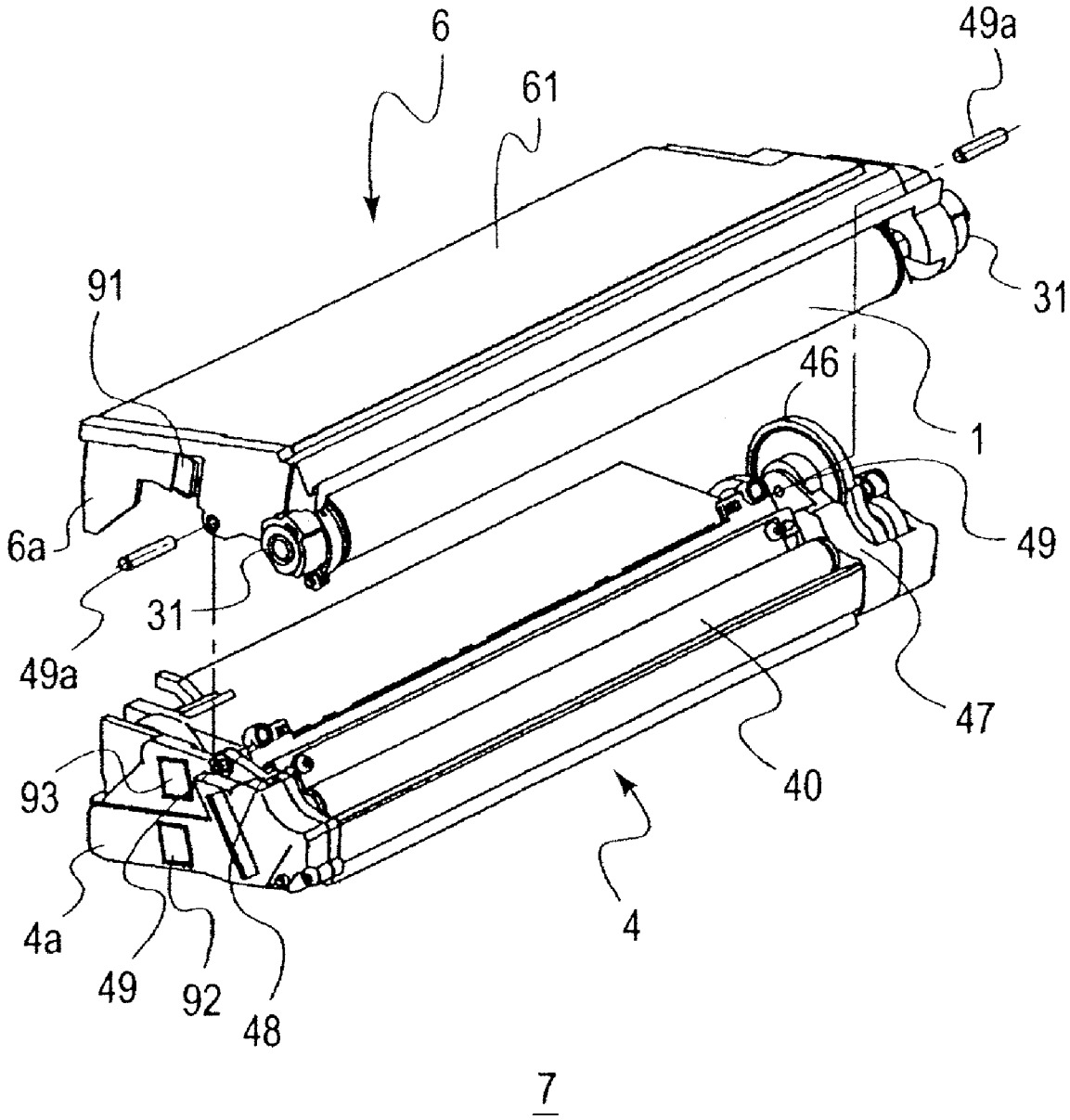
FIG. 4 is a perspective view of the process cartridge in a partially disassembled state, showing the general structure thereof.
Figure 5:
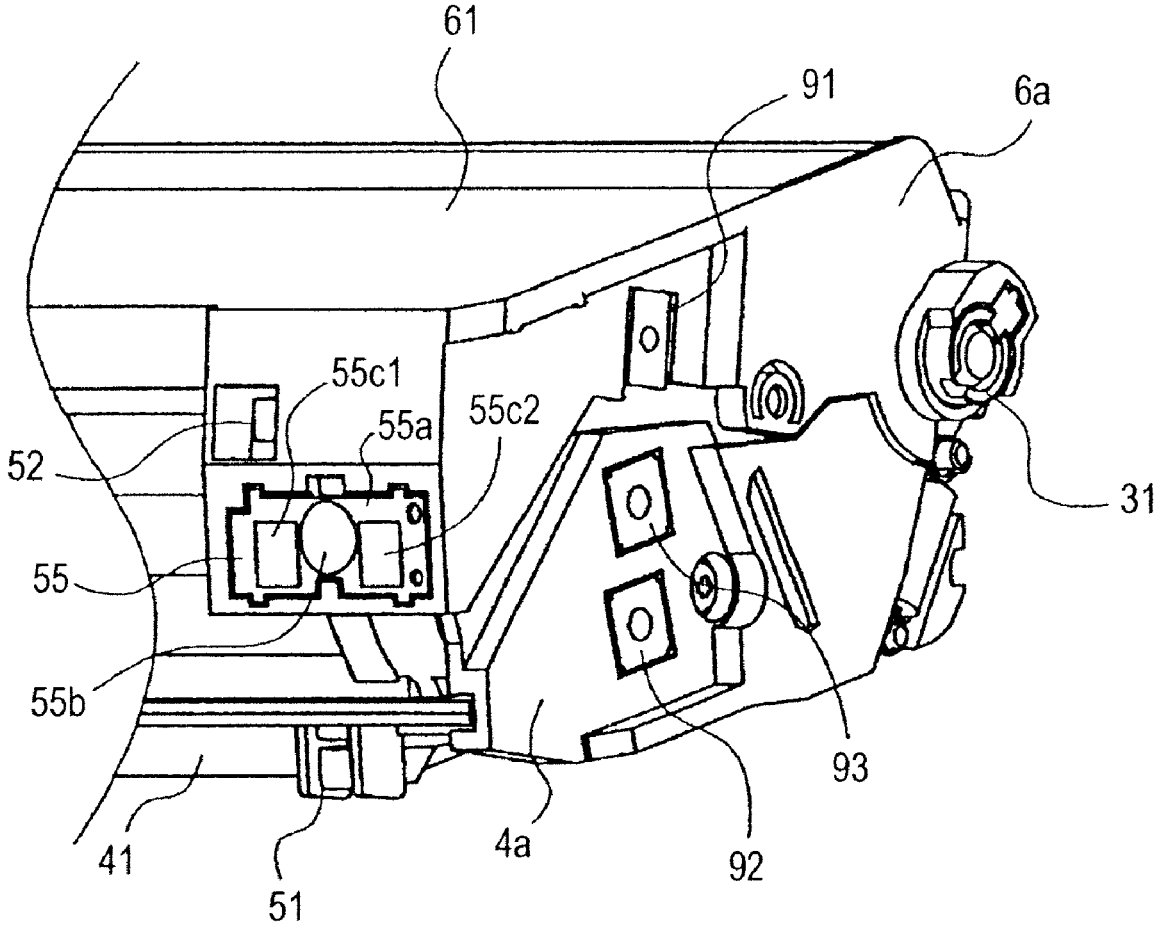
FIG. 5 is a perspective view of the portion of the process cartridge, in the preferred embodiment, equipped with a transmission-type developer remainder amount detecting means, showing the state of the process cartridge, in which the beam of detection light has reached the beam receiving portion.

Next, referring to FIGS. 3-5, the structure of the cartridge 7 will be described. FIG. 3 is a sectional view of the essential portion of the cartridge 7 containing the developer t, and FIG. 4 is a perspective view of the cartridge 7. In FIG. 4, the second and first frames 4 and 6 are separated from each other. FIG. 5 is a perspective view of the cartridge 7, as seen from the opposite side from the photosensitive drum 1. More specifically, FIG. 5 is a perspective view of the lengthwise ends of the frames 4 and 6, on their front sides in terms of the direction in which the cartridge 7 is inserted into the apparatus main assembly A.

Referring to FIG. 3, the housing of the cartridge 7 comprises the first frame 6 and second frame 4, which can be separated from each other. The first frame 6 holds the electrophotographic photosensitive drum 1, that is, an electrophotographic photosensitive member in the form of a drum, the charge roller 2, and the cleaning blade 60, whereas the second frame 4 holds the development roller 40 for developing an electrostatic latent image on the photosensitive drum 1.

To the first frame 6, the photosensitive drum 1 is rotatably attached, with a pair of bearings 31 (cartridge positioning members) placed between the photosensitive drum 1 and the first frame 6. Around the peripheral surface of the photosensitive drum 1, the charge roller 2 for uniformly charging the peripheral surface of the photosensitive drum 1, and the cleaning blade 60 for removing the developer remaining on the peripheral surface of the photosensitive drum 1, are placed in contact with the peripheral surface of the photosensitive drum 1.

As the developer remaining on the peripheral surface of the photosensitive drum 1 is cleaned by the cleaning blade 60, it is conveyed by the developer conveying mechanism 62 to a waste developer chamber 63 located in the rear portion of the drum unit frame 61. To the helical gear 46 located at the other lengthwise end of the second frame 4, the driving force of a motor (unshown) is transmitted. In other words, the helical gear 46 is the gear which receives from the apparatus main assembly A the force for rotating the development roller 40, the developer supplying roller 43, and the developer conveying member 42, while the cartridge 7 is in the apparatus main assembly A. Also, the photosensitive drum 1 is rotationally driven (in counterclockwise direction) in synchronism with an image forming operation, by the force transmitted from the apparatus main assembly A. The lengthwise end portions of the axle of the photosensitive drum 1 are fitted with the aforementioned pair of bearings 31, and in order to precisely position the cartridge 7 relative to the image forming apparatus main assembly A, the cartridge 7 is positioned relative to the side plates 106 of the image forming apparatus main assembly A, with the pair of bearings 31 positioned between the side plates 106, and lengthwise ends of the axle of the photosensitive drum 1, one for one.

The second frame 4 holds the development roller 40, which is rotated (in the direction indicated by arrow Y) in contact with the photosensitive drum 1. It also has the developer storage portion 41 which contains the developer. Further, it has a developing means container 45. The development roller 40 is rotatably supported by the developing means container 45, with the development roller bearings 47 and 48 placed between the development roller 40 and the developing means container 45. In the adjacencies of the peripheral surface of the development roller 40, the developer supplying roller 43, which is rotated (in the direction indicated by arrow mark Z) while being pressed against the development roller 40, and development blade 44, are located. Further, within the developer storage portion 41, the developer conveying mechanism 42 for conveying the developer, while stirring it, to the developer supplying roller 43 is provided.

Next, referring to FIG. 4, the second frame 4 is attached to the first frame 6 in such a manner that it can be pivoted about the pair of pins 49*a* fitted in the hole 49 of the development roller bearing 47 and the hole 49 of the development roller bearing 48, one for one.

When the cartridge 7 is not in the apparatus main assembly A, the second frame 4 is kept constantly pressed by a pair of compression springs 64 in the direction to be rotated about the pair of pins 49*a* so that the development roller 40 is kept pressured toward the photosensitive drum 1 by the moment generated by the pair of compression springs 64.

During development, the developer in the developer storage portion 41 is conveyed by the developer stirring member 42 to the developer supplying roller 43, which is being rotated (in the direction indicated by arrow mark Z) while rubbing against the development roller 40 which is also being rotated (in the direction indicated by arrow mark Y). As a result, the developer is supplied to the peripheral surface of the development roller 40, being thereby borne on the peripheral surface of the development roller 40. Then, the developer borne on the peripheral surface of the development roller 40 is delivered by the rotation of the development roller 40 to the development blade 44, which forms the body of developer on the peripheral surface of the development roller 40 into a thin layer of the developer with a predetermined thickness, while charging the developer. Then, the thin layer of the developer is delivered by the rotation of the development roller 40 to the development station, in which the peripheral surface of the photosensitive drum 1 is in contact with the peripheral surface of the development roller 40, and development bias (DC voltage) is applied to the development roller 40 from the power source (unshown) of the image forming apparatus 100 by way of a development power supply contact 92, so that the developer particles in the thin layer of the developer are adhered to the peripheral surface of the photosensitive drum 1, in the pattern of the electrostatic latent image on the peripheral surface of the photosensitive drum 1, developing thereby the latent image into a visible image.

The developer which did not contribute to the development, that is, the developer remaining on the peripheral surface of the development roller 40, is returned by the rotation of the development roller 40 to the developing means container 45, in which the developer is stripped (it is recovered) from the peripheral surface of the development roller 40 by the developer supplying roller 43 which is being rotated while rubbing the development roller 40. The recovered developer is stirred and mixed with the developer in the developing means container 45, by the developer stirring mechanism 42.

The cartridge 7 is provided with a charge bias electrical contact 91 for supplying the charge roller 2 with high voltage from the power source (unshown) on the main assembly side, a development bias electrical contact 92 for supplying the development roller 40 and the developer supplying roller 43 with high voltage from the power source (unshown) on the main assembly side, and a blade bias electrical contact 93 for supplying the development blade 44 with high voltage. These electrical contacts 91, 92, and 93 are attached to one of the lengthwise end walls, that is, the walls perpendicular to the direction parallel to the axial direction of the photosensitive drum 1. More specifically, the charge bias electrical contact 91 is attached to one of the lengthwise end walls (in terms of the direction parallel to the aforementioned axial line) of the first frame 6 supporting the charge roller 2.

The electrical contact 92 for supplying the development roller and the developer supplying roller with bias, and the blade bias electrical contact 93, are attached to one of the lengthwise end walls (in terms of the direction parallel to the aforementioned axial line) of the second frame 4 supporting the development roller 40, the developer supplying roller 43, and the development blade 44. In other words, the electrical contacts 91, 92, and 93 are attached to the lengthwise end walls 4*a* and 6*a* of the second and first frames 4 and 6, respectively, in terms of the lengthwise direction of the frames, being exposed from the end walls 4*a* and 6*a*, which are on the same end of the cartridge 7 in terms of the lengthwise direction of the cartridge 7.

As the cartridge 7 is inserted into the apparatus main assembly A, these electrical contacts 91, 92, and 93 come into contact with the charge bias electrical contacts (for example, 111Y, and 111K), the development bias electrical contacts (for example, 112Y, and 112K), and the blade bias electrical contacts (for example, 113Y, and 113K) of the apparatus main assembly A, being thereby enabled to supply the corresponding components of the cartridge 7 with electric power. The electrical contacts 91, 92, and 93 are electrically connected to the corresponding components in the cartridge 7, and so are the electrical contacts 111Y, 111K, 112Y, 112K, 113Y, and 113K of the apparatus main assembly A.

More specifically, the first frame 6 holds the charge roller 2 for charging the photosensitive drum 1. The end wall 6*a* of the first frame 6, located at one of the lengthwise ends of the first frame 6 in terms of the direction parallel to the axial direction of the photosensitive drum 1, is provided with the charge bias electrical contact 91, through which voltage is supplied to the charge roller 2 from the apparatus main assembly A when the cartridge 7 is in the apparatus main assembly A.

The second frame 4 holds the development roller 40 as a latent image developing member, the development blade 44 for regulating the amount of the developer to be kept adhered to the peripheral surface of the development roller 40, and the developer supplying roller 43 for supplying the peripheral surface of the development roller 40 with the developer. The lengthwise end wall 4*a* of the second frame 4, located at one of the lengthwise ends of the second frame 6 in terms of the direction parallel to the axial line of the electrophotographic photosensitive drum, is provided with the blade bias electrical contact 92 for supplying the development blade 44 with voltage from the image forming apparatus main assembly A when the cartridge 7 is in the apparatus main assembly A. The end wall 4*a* of the second frame 4 is also provided with the development bias electrical contact 92 (developer supplying bias electrical contact) through which the development voltage, and the voltage for the developer supplying roller 43, are supplied to the development roller 40 and the developer supplying roller 43, from the image forming apparatus main assembly A, when the cartridge 7 is in the image forming apparatus main assembly A.

With the employment of the above-described structural arrangement, all the electrical contacts of the cartridge 7 are placed at one of the lengthwise ends of the cartridge 7, making it possible to place all the electrical contacts of the apparatus main assembly A on the same end of the apparatus main assembly A. In other words, the electrical junction of the apparatus main assembly A can be placed at one end of the electrical circuit board of the apparatus main assembly A.

[Cartridge Supporting Structure of Image Forming Apparatus]

Figure 6:
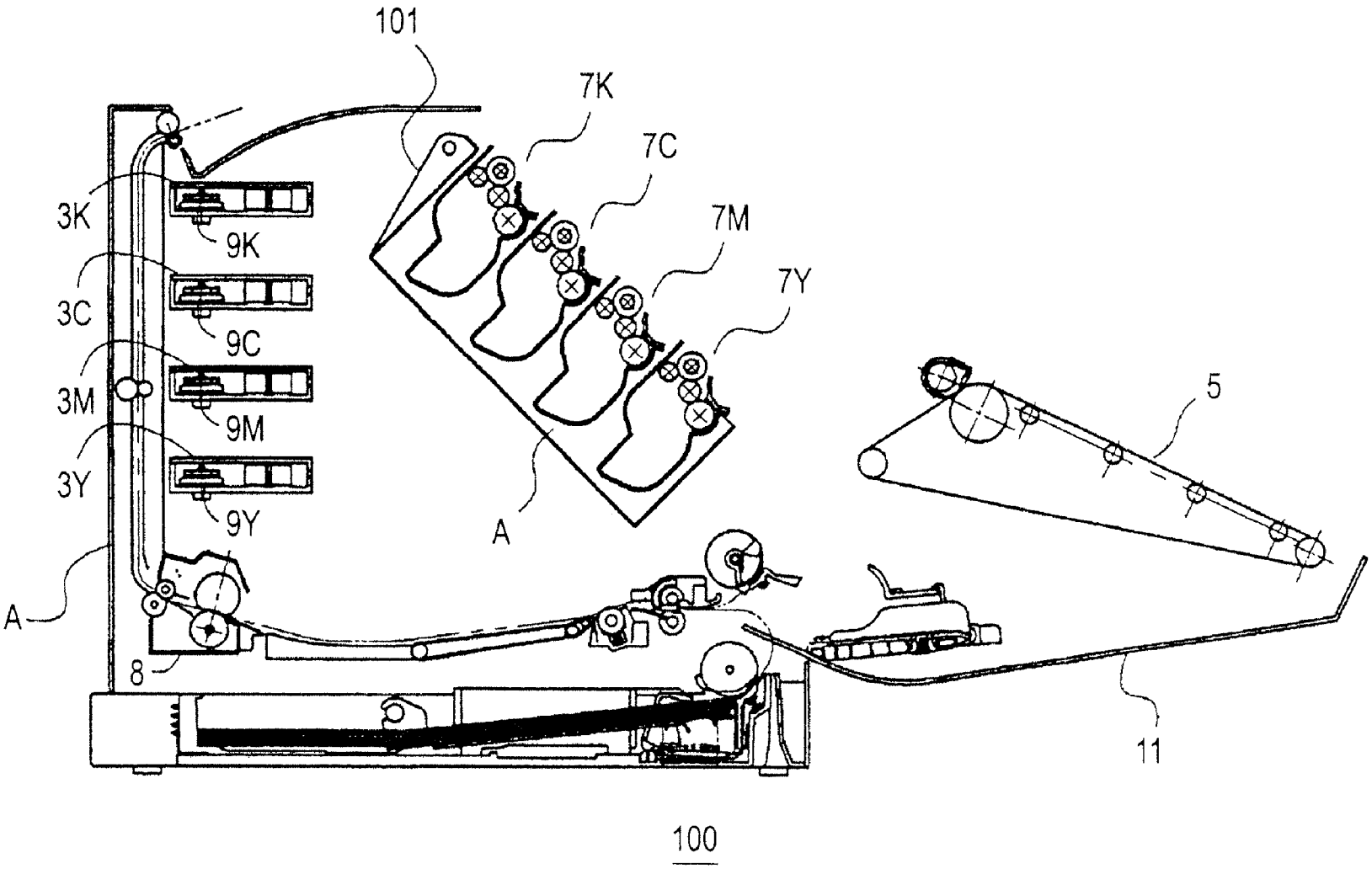
FIG. 6 is a sectional view of the portion of the process cartridge, in the first embodiment, equipped with a transmission-type developer remainder amount detecting means, showing the state of the process cartridge, in which the beam of detection light has not reached the beam receiving portion.
Figure 7:
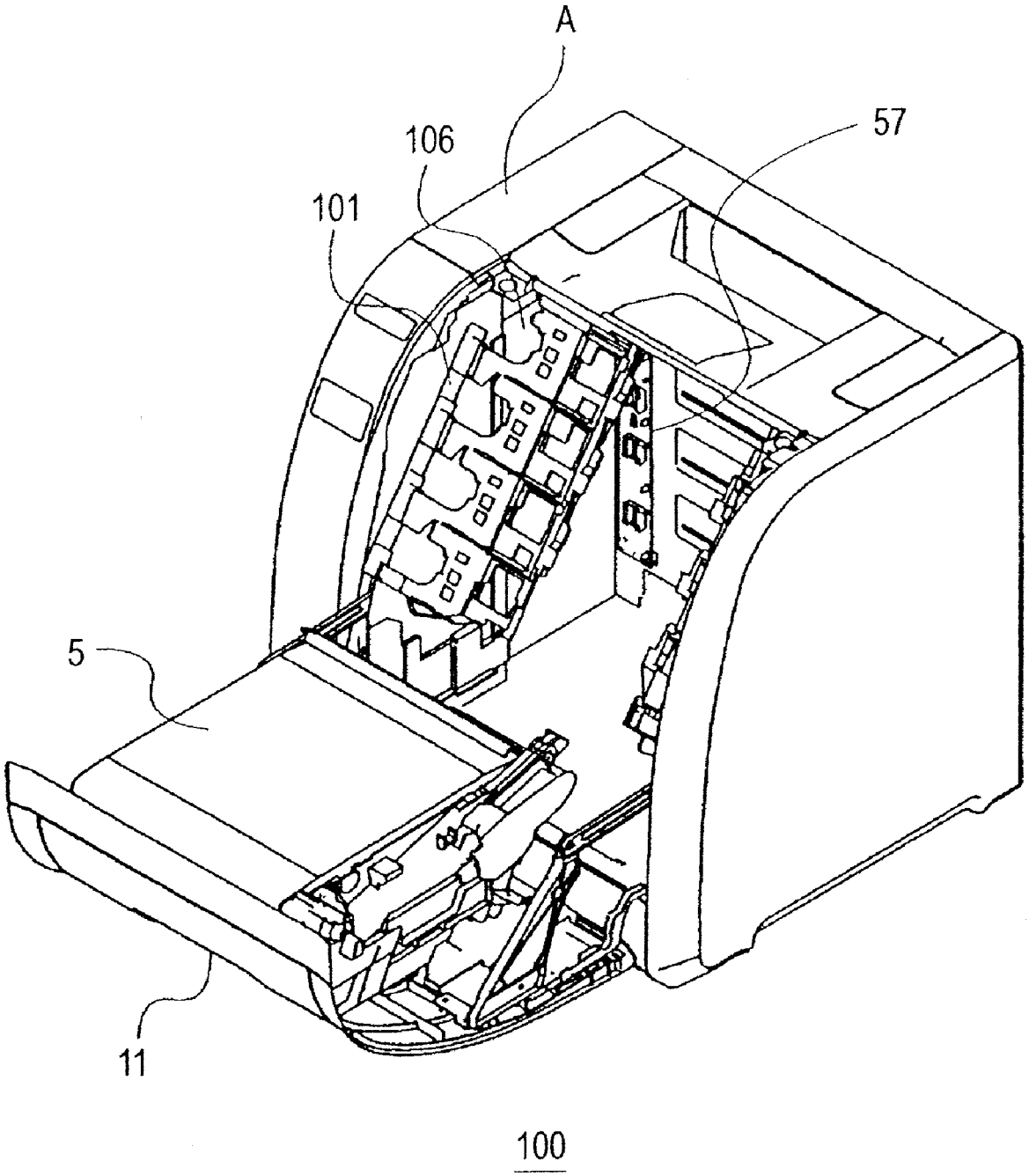
FIG. 7 is a perspective view of the process cartridge, in the preferred embodiment, comprising a storage means.
Figure 8:
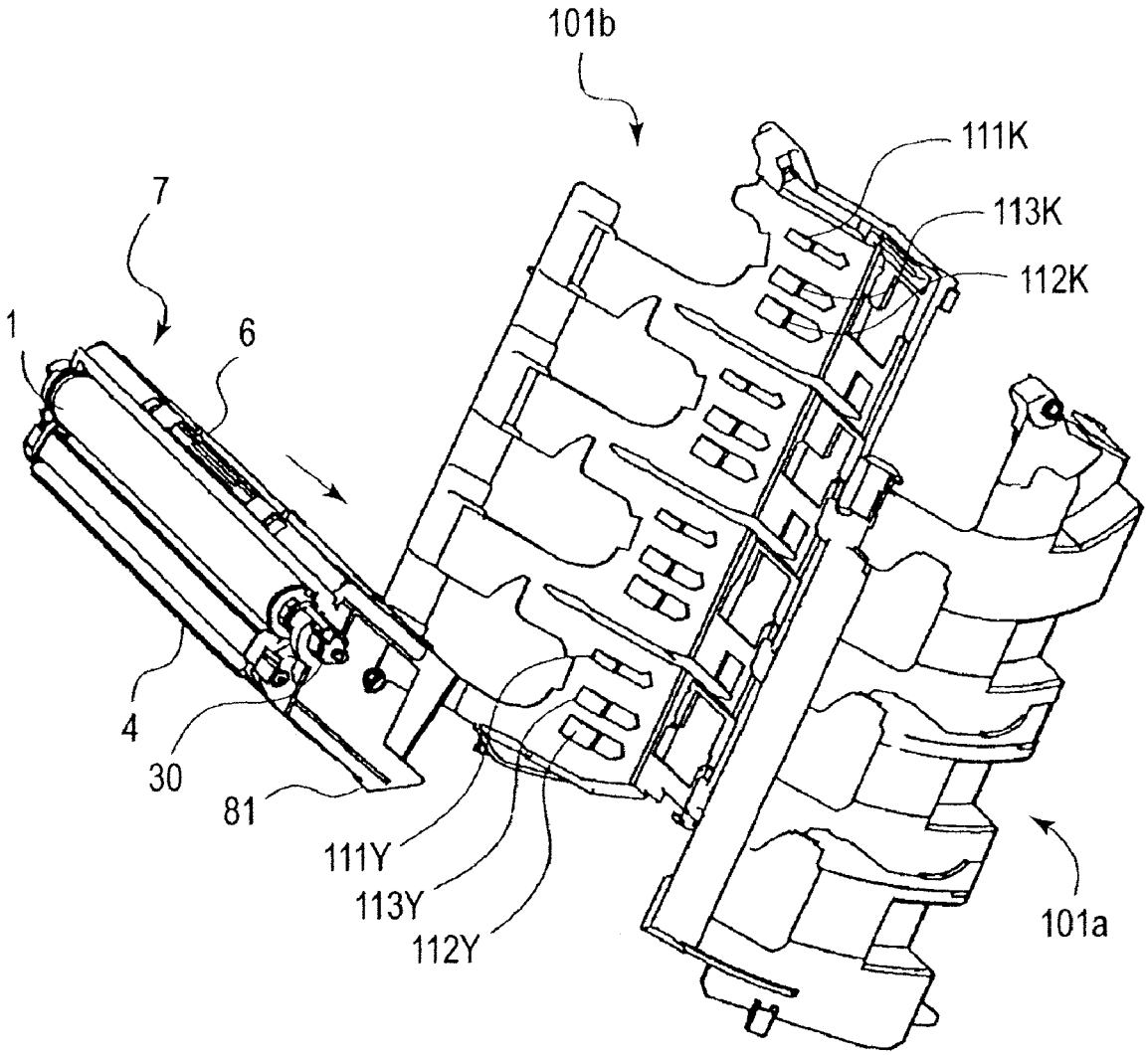
FIG. 8 is a perspective view of a part of the process cartridge in the preferred embodiment, showing the positioning of the light guides and storage unit.
Figure 9:
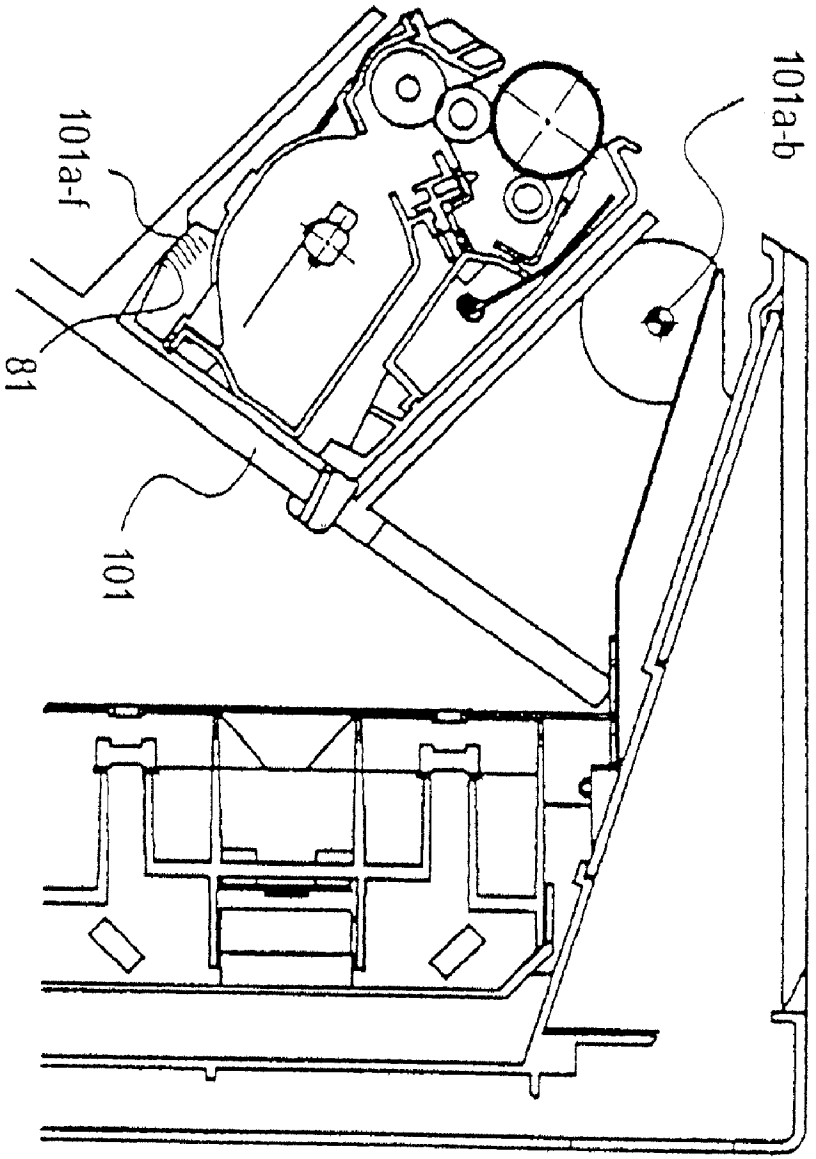
FIG. 9 is a schematic sectional view of the process cartridge in accordance with the present invention, and its adjacencies, in an image forming apparatus, showing the state of the process cartridge in the image forming apparatus.
Figure 10:
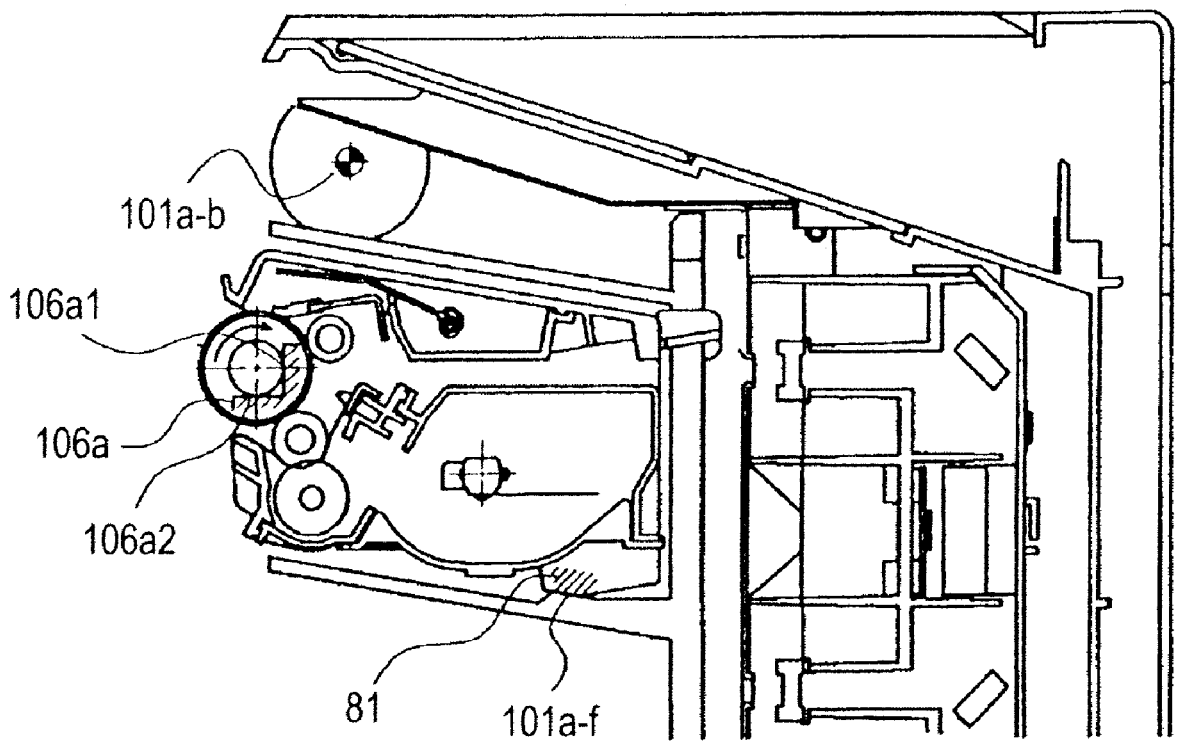
FIG. 10 is a view of the component of the image forming apparatus in the preferred embodiment of the present invention, having the beam emitting portion, beam receiving portion, and communicating means.

Next, referring to FIGS. 6-10, the cartridge supporting structure of the image forming apparatus 100 will be described. FIG. 6 is a sectional view of the image forming apparatus, the hinged cover 11 of which is open, and FIG. 7 is a perspective view of the same image forming apparatus. FIG. 8 is a perspective view of the cartridge supporting portion (plate) of the image forming apparatus, depicting the structure thereof, and FIG. 9 is a drawing for depicting the structure of the cartridge positioning portion of the image forming apparatus main assembly A for positioning the cartridge 7 as the cartridge 7 is inserted into one of the cartridge compartments of the apparatus main assembly A. FIG. 10 is a drawing for depicting the cartridge 7 in the apparatus main assembly A after the precise positioning of the cartridge 7 in the apparatus main assembly A by closing the hinged cover 11. Incidentally, FIGS. 9 and 10 show the cartridge in the top cartridge compartment of the image forming apparatus main assembly A; the other cartridge compartments of the image forming apparatus main assembly A, that is, the cartridge compartments for the cartridges 7 for the colors different from the one shown in FIGS. 9 and 10, which are the same in structure as the cartridge compartment shown in FIGS. 9 and 10, are not shown.

The rotational axis of the hinged cover 11 is located in the bottom portion of the image forming apparatus 100. To the hinged cover 11, the aforementioned intermediary transferring member 5 is attached. Therefore, opening the hinged cover 11 makes it possible for an operator to access the cartridges 7Y, 7M, 7C, and 7K. What is holding the cartridges 7Y, 7M, 7C, and 7K is a cartridge holding member 101, the rotational axis 101*a-b* of which, that is, the axis of the cartridge holding member supporting member, is located in the top portion of the apparatus main assembly A.

The cartridge holding member 101 is connected to the hinged cover 11 by a linkage (unshown). Thus, opening the hinged cover 11 makes the cartridge holding member 101 rotate (roughly 45 degrees in this embodiment) about the pivot 101*a-b*, thereby causing the cartridges 7 in the cartridge holding member 11 to orbitally move through a predetermined angle (roughly 40 degrees in this embodiment) about the pivot 101*a-b*. In other words, opening the hinged cover 11 makes it easier to insert the cartridges 7 into the apparatus main assembly A, or remove them therefrom.

In this embodiment, for cost reduction, the left-and right-hand portions (101*a* and 101*b*) of the cartridge holding member 101 are separately formed, and then, are joined. However, the cartridge holding member 101 may be formed as a single-piece member. When the left- and right-hand portions are separately formed, the two portions are solidly held together by a linking member. Therefore, the two-piece cartridge holding member 101 is virtually the same in structure as a single-piece cartridge holding member 101.

Referring to FIG. 8, the portion 101*b* of the cartridge holding member 101 is provided with four sets of the charge bias electrical contacts, development bias-development supply bias electrical contacts, and development blade bias electrical contacts, one set for each of the four cartridge compartments, as the electrical contacts for supplying the cartridges 7 with the aforementioned high voltages. Thus, as the cartridge 7 is inserted into the cartridge holding member 101 in the direction indicated by an arrow mark in the drawing, the aforementioned charge bias electrical contact 91, development bias-developer supplying bias electrical contact 92, and blade bias electrical contact 93 of the cartridge 7 come into contact with the charge bias, development bias-development supply bias, and development blade bias electrical contacts of the portion 101*b* of the cartridge holding member 101, respectively. Incidentally, the direction in which the cartridge 7 is inserted into the image forming apparatus 100 is the direction perpendicular to the lengthwise direction (axial direction) of the photosensitive drum 1.

Next, the cartridge 7 and the cartridge holding member 101 will be described regarding their structures for making the closing of the hinged cover 11 precisely position the cartridge 7 relative to the cartridge holding member 101.

After the cartridge holding member 101 is rotated outward roughly 45 degrees from the position in which it is kept when forming an image, the cartridge 7 can be effortlessly inserted into the apparatus main assembly A.

Referring to FIG. 9, as the cartridge 7 is inserted into the first position, which is the deepest position for the cartridge 7 in the cartridge holding member 101, the cartridge regulating portion 81 of the cartridge 7 comes into contact with the cartridge regulating portion 101*a-f* of the apparatus main assembly A, which is a part of the cartridge holding portion 101.

Next, the hinged cover 11 is to be closed. As the hinged cover 11 is closed, the cartridge holding member 101 is moved into the image forming apparatus main assembly A by the linkage connected to the hinged cover 11 and cartridge holding member 101, causing the cartridge 7 to move into the second position, as shown in FIG. 10, in which the cartridge 7 can be used for image formation. As the cartridge 7 is moved into the second position, the drum shaft bearings 31 (first and second cartridge positioning portions) fitted around the lengthwise end portions of the photosensitive drum 1 and projecting outward from the lengthwise ends of the first frame 6 in the axial direction of the photosensitive drum 1, fit into the positioning portions 106*a* (first and second positioning portions), one for one, of the side plates 106 of the image forming apparatus main assembly A, and each of the bearings 31 is pressed against the two surfaces 106*a* and 106*a*2 of the side plate 106, on the corresponding side, facing rearward, in terms of the cartridge insertion direction, and upward, respectively.

Also as the cartridge 7 is moved into the second position in the apparatus main assembly A, the cartridge regulating portion 81 of the cartridge 7 comes into contact with the cartridge regulating portion 101*a-f* of the apparatus main assembly A.

In other words, the cartridge 7 is provided with a first cartridge positioning portion comprising the bearing 31, which is located at one of the lengthwise ends of the first frame 6, and which comes into contact with a first cartridge positioning portion comprising the positioning portion 106*a* of the image forming apparatus main assembly A to precisely position the cartridge 7 relative to the apparatus main assembly A when the cartridge 7 is inserted into the image forming apparatus main assembly A. The cartridge 7 is also provided with a second cartridge positioning portion comprising another bearing 31, which is located at the other lengthwise end of the first frame 6, and which comes into contact with a second cartridge positioning portion comprising another positioning portion 106*a* of the image forming apparatus main assembly A in order to precisely position the cartridge 7 relative to the image forming apparatus main assembly A as the cartridge 7 is inserted into the image forming apparatus main assembly A. Further, the cartridge 7 is provided with the cartridge regulating portion 81, which is a part of the first frame 6, and which comes into contact with the cartridge regulating portion 101*a-f* of the image forming apparatus main assembly A, thereby regulating the rotation of the cartridge 7 about the first and second cartridge positioning portions 31 of the cartridge 7, when the cartridge 7 receives the driving force transmitted from the image forming apparatus main assembly A.

Next, the reception, by the cartridge 7, of the diving force transmitted from the image forming apparatus 100 will be described.

The cartridge 7 is provided with a driving force receiving portion 30 (coupler) connected to one of the lengthwise ends of the supporting shaft of the photosensitive drum 1. As the driving force receiving portion 30 is engaged with the driving force transmitting means (unshown) of the apparatus main assembly A, the driving force is transmitted to the photosensitive drum 1, thereby rotating the photosensitive drum 1 in the clockwise direction (FIG. 10). As the photosensitive drum 1 receives the driving force, the first frame 6 is subjected to such a moment that acts in the direction to rotate the first frame 6 in the direction indicated by the arrow mark, about the line which coincides with the axial lines of the pair of bearings 31 as the first and second cartridge positioning portions. As a result, the first frame 6 is rotated in the direction indicated by the arrow mark, thereby causing the cartridge regulating portion 81 as the third cartridge positioning portion to come into contact with the cartridge regulating portion 101*a-f* of the apparatus main assembly A. The contact between the cartridge regulating portion 81 and the cartridge regulating portion 101*a-f* caused by the moment fixes the attitude of the cartridge 7 in terms of the direction in which the cartridge 7 is pivoted by the moment generated as the photosensitive drum 1 is rotationally driven by the driving force from the apparatus main assembly A. As a result, the cartridge 7, in particular, the photosensitive drum 1 in the cartridge 7, is precisely positioned relative to the apparatus main assembly A.

[Structure of Stirring Member, and Detection of Developer Remainder Amount by Beam Transmission]

Figure 11:
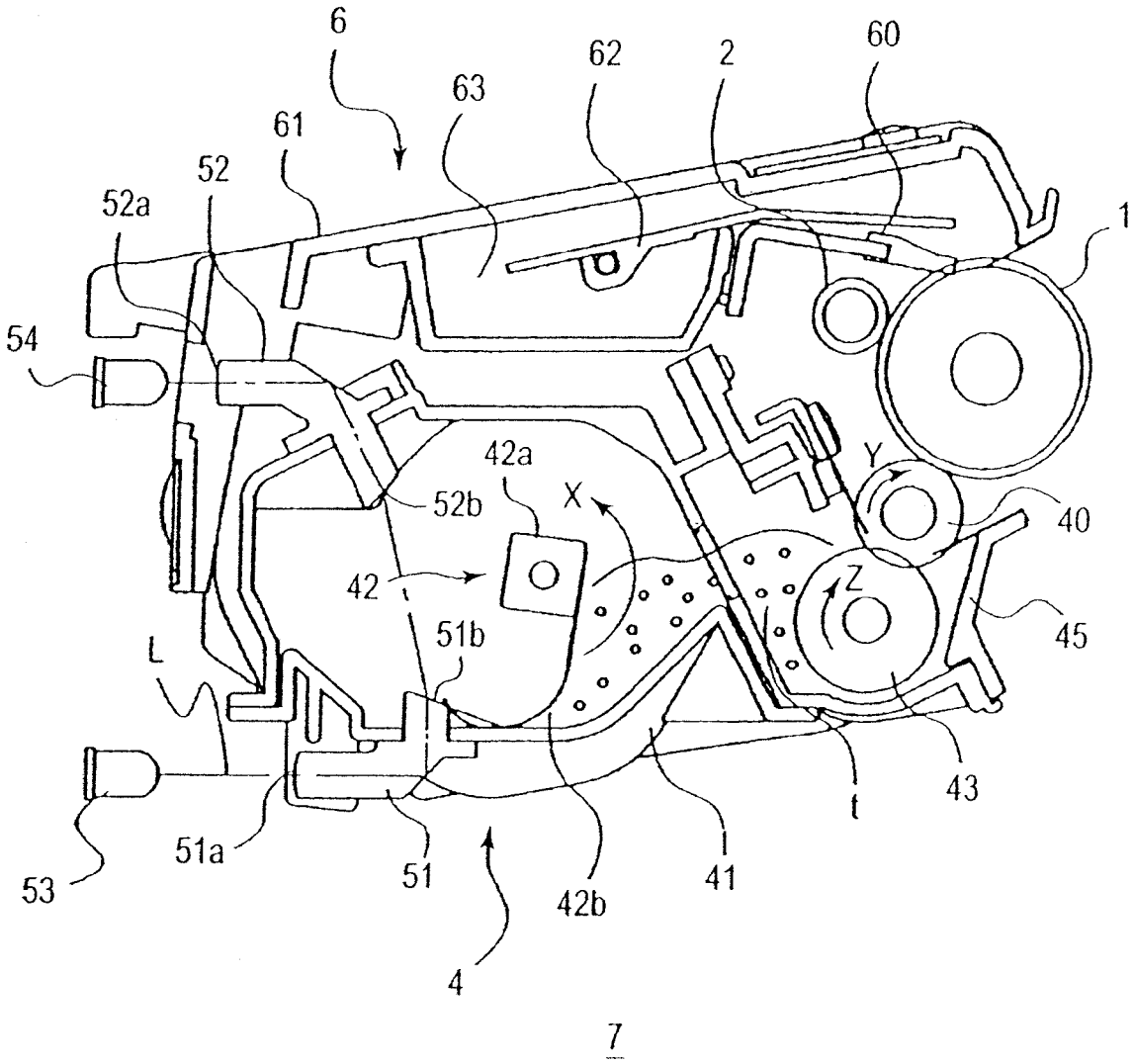
FIG. 11 is a sectional view of a cartridge showing the structure of its developer remainder amount detecting means of a transmission type.
Figure 12:
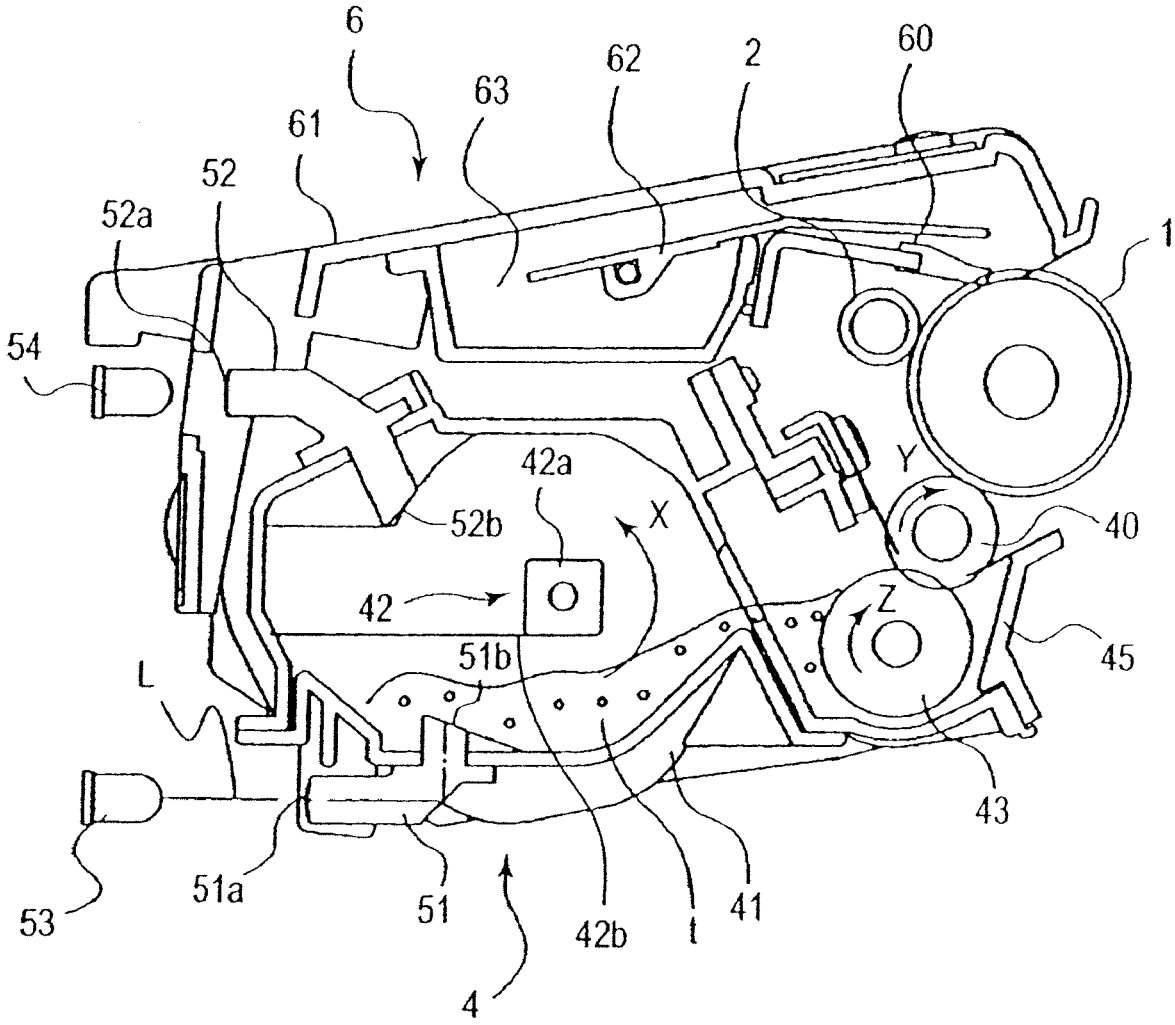
FIG. 12 is also a sectional view of a process cartridge, showing the structure of its developer remainder amount detecting means of a transmission type.

Next, referring to FIGS. 11 and 12, the detection of the developer remainder amount by beam transmission will be described. FIG. 11 is a sectional view of the cartridge 7, in accordance with the present invention, equipped with a transmission-type developer remainder amount detecting means, in which the beam of detection light has reached the beam receiving portion, and FIG. 12 is a sectional view of the transmission-type developer remainder amount detecting means, in which the beam of detection light has not reached the beam receiving portion.

Referring to FIG. 11, within the developer storage portion 41, a developer stirring member 42 is positioned. The rotation of the developer stirring member 42 in the direction indicated by the arrow mark X conveys the developer to the developer supplying roller 43. The stirring member 42 comprises a shaft 42*a*, and a flexible sheet 42*b* for conveying the developer while stirring it.

The force for driving the stirring member 42 is transmitted thereto by a driving gear (unshown) inserted through the hole in one of the side walls of the developer storage portion 41.

The developer storage portion 41 is provided with first and second beam guides 51 and 52, each of which is the integral combination of a transparent window and a beam guiding portion. The first light guide 51 is on the side from which the beam of detection light enters. The first and second light guide 51 and 52 are near the aforementioned end walls 4*a* and 6*a* (FIG. 5), respectively, in terms of the lengthwise direction of the cartridge 7. The first light guide 51 is for guiding the beam L of the developer remainder amount detection light emitted from a beam emitting portion 53 (LED) located in the image forming apparatus main assembly A, into the developer storage portion 41. After passing through the developer storage portion 41, the detection beam L is guided by the second beam guide to the beam receiving portion 54 (photo-transistor) located also in the image forming apparatus main assembly A. As the aforementioned flexible sheet 42*b* of the developer stirring member 42 is rotated, not only does it interrupt the detection beam L, but also cleans the inward surface 51*b* of the first light guide 51, and the inward surface 52*b* of the second light guide 52.

In this embodiment, incidentally, the outward surface 52*a* of the second light guide 52, from which the detection beam L exits, is located a predetermined distance forward, in terms of the direction in which the cartridge 7 is inserted into the image forming apparatus main assembly A (leftward in FIGS. 11 and 12), relative to the outward surface 51*a* of the first light guide 51, from which the detection beam L is guided into the developer storage portion 41.

FIG. 11 shows the state of the cartridge 7 immediately after the cleaning of the beam transmission surface 51*b* of the first light guide 51 by the flexible sheet 42*b*. The amount of the developer remainder in the developer storage portion 41 shown in FIG. 11 is relatively small. Thus, the detection beam L is allowed to uninterruptedly travel through the developer storage portion 41 to be transmitted through the second light guide 52, and is detected by the beam receiving portion 54. In comparison, FIG. 12 shows the state of the cartridge 7 immediately before the flexible sheet 42*b* begins to clean the detection beam transmission surface 51*b*. When the cartridge 7 is in the state shown in FIG. 12, the detection beam L is blocked by the developer stirring member 42 as well as the developer in the developer storage portion 41, being therefore prevented from reaching the second beam guide 52; in other words, the detection beam L is not detected by the beam receiving portion 54 located in the image forming apparatus main assembly A.

When the cartridge 7 is structured as described above, it is possible to detect the length of time the detection beam L is allowed to freely travel through the developer storage portion 41 per rotation of the stirring member 42. This length of time is processed by the control portion of the apparatus main assembly A following a predetermined procedure in order to estimate the amount of the remaining developer remaining in the developer storage portion 41. With the employment of this procedure, the amount of the remaining developer remaining in the developer storage portion 41 can be reasonably precisely estimated when the amount of the developer remaining in the developer storage portion 41 is in the range of 0%-25% of the effective developer capacity of the developer storage portion 41.

To summarize, the second frame 4 of the cartridge 7 is provided with the first and second beam guides 51 and 52, which are located near one of the lengthwise ends in terms of the direction parallel to the axial line of the photosensitive drum 1, and at the front end in terms of the direction in which the cartridge 7 is mounted. The first beam guide 51 is positioned so that when the cartridge 7 is in the apparatus main assembly A, the beam entrance surface 51 a of the first beam guide 51 directly faces the aforementioned beam emitting portion 53 located in the apparatus main assembly A, and the second beam guide 52 is positioned so that when the cartridge 7 is in the apparatus main assembly A, the beam exit surface 52*a* of the second beam guide 52 directly faces the aforementioned beam receiving portion 54.

Further, when the cartridge 7 is in the apparatus main assembly A, the first frame 6 is located on top of the second frame 4, and the first beam guide 51 is located under the developer storage portion 41, guiding the detection beam L emitted from the beam emitting portion 53, into the developer storage portion 41; the detection beam L enters the first beam guide 51 and is transmitted into the developer storage portion 41 through the detection beam guide 51, whereas the second beam guide 52 is located on top of the developer storage portion 41, guiding the detection beam L to the beam receiving portion 54 after the detection beam L travels through the developer storage portion 41; the detection beam L exits from the beam exit surface 52*a* and reaches the beam receiving portion 54. Incidentally, "at one of the lengthwise ends" means "nearer to one of the lengthwise ends than to the center of the second frame in terms of the direction parallel to the axial direction of the photosensitive drum 1".

Structuring the cartridge 7 as described above makes it possible to avoid positioning the beam emitting portion 53 so that it overlaps with the photosensitive drum 1 in terms of the direction perpendicular to the axial line of the photosensitive drum 1. Therefore, it prevents the photosensitive drum 1 from being exposed to the detection beam L, raising thereby the level of image quality at which an image is formed.

As seen from the direction parallel to the axial line of the photosensitive drum 1 held by the second frame 4, the second beam guide 52 is located forward of the first beam guide 51 in terms of the direction in which the cartridge 7 is inserted into the apparatus main assembly A; the beam exit surface 52*a* is forward of the beam entrance surface 51*a*.

[Structure Storage Means of Process Cartridge]

Figure 13:
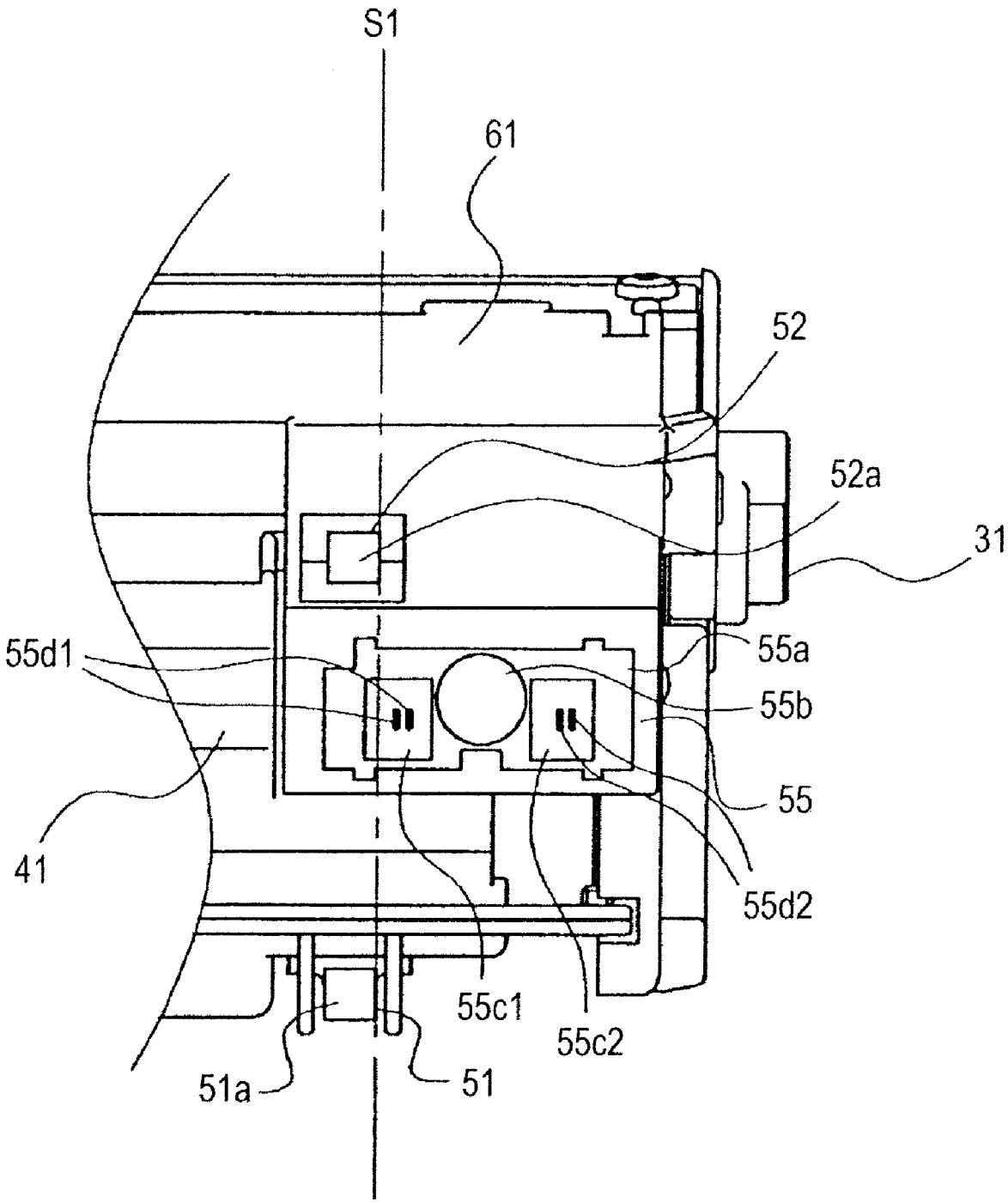
FIG. 13 is a rear view of the process cartridge, showing the structures and positioning of the beam guides and storage means thereof.

Next, referring to FIGS. 1 and 13, the storage means of the cartridge 7 will be described regarding the structure of and communication with the image forming apparatus main assembly A. FIG. 13 is a rear view of the cartridge 7 having a storage means, in accordance with the present invention.

The storage means 55 (which hereinafter may be referred to as a memory unit) is located at the front end of the cartridge 7 in terms of the cartridge insertion direction. The memory unit 55 comprises a memory 55*b*, first and second electrical contacts 55*d*1 and 55*d*2 as electrical contacts on the cartridge side, a pair of conductive areas 55*c*1 and 55*c*2, and a dielectric substrate 55*a*, on which the preceding portions are placed. The first and second contacts 55*d*1 and 55*d*2 are within the conductive areas 55*c*1 and 55*c*2, respectively, which are positioned in a manner to sandwich the memory 55*b* from the left and right sides, respectively.

The cartridge 7 is provided with an electrical contact, which is located at one end of the first frame 6 in terms of the direction parallel to the axial direction of the photosensitive drum 1, and at the front end of the cartridge 7 in terms of the cartridge mounting direction, and which comes into contact with the electrical contact 56*a* of the image forming apparatus main assembly A, thereby transmitting the data stored in the memory 55*b* to the image forming apparatus main assembly A, as the cartridge 7 is mounted into the image forming apparatus main assembly A.

The memory 55*b*, the first conductive area 55*c* 1 having the first electrical contact 55*d*1 as the electrical contact on the cartridge side, and the second conductive area 55*c*2 having the second electrical contact 55*d*2 as the electrical contact on the cartridge side, are on the same substrate 55*a*. Listing from the inward side of the cartridge 7 in terms of the aforementioned direction parallel to the axial line of the photosensitive drum 1, the first conductive area 55*c*1, the memory 55*b*, and the second conductive area 55*c*2 are disposed on the substrate 55*a*. Further, the straight line S1 (FIG. 13) connecting the outward edge of the beam entrance portion (surface) 51*a* in terms of the direction parallel to the axial line of the photosensitive drum 1 held by the second frame 4, and the outward edge of the beam exit portion (surface) 52*a*, overlaps with at least a part of the substrate 55*a*, as seen from the direction perpendicular to the drawing. In this embodiment, the straight line S1 crosses the first conductive area 55*c*1, which is on the inward side of the memory 55*b* in terms of the direction parallel to the axial line of the photosensitive drum 1.

Structuring the cartridge 7 as described above makes it possible to utilize the space between the first and second beam guides, which otherwise is a dead space. In particular, it makes it possible to reduce the dimension of the cartridge 7 in terms of the direction parallel to the axial line of the photosensitive drum 1.

Referring to FIG. 13, in this embodiment, the cartridge 7 is provided with two first electrical contacts 55*d*1, which are located in the first conductive area 55*c*1, and two second electrical contacts 55*d*2, which are located in the second conductive area 55*c*2, improving the cartridge 7 in reliability of electrical connection. The image forming apparatus main assembly A is provided with a communication unit 56 (shown in FIG. 14) as a communicating means connected to the controller (unshown). As the cartridge 7 is inserted into the apparatus main assembly A, the electrical contacts 55*d*1 and 55*d*2 of the memory unit 55, within the first and second conductive areas 55*c*1 and 55*c*2, respectively, come into contact with the communication contacts 56*a* (electrical contacts on the main assembly side shown in FIG. 15), making possible the communication between the memory 55*b* of the memory unit 55, and a controller of the apparatus main assembly A (making it possible to read data in memory 55*b*, or write data into memory 55*b*).

The data to be stored in the memory 55*b* are one or more of various parameters showing the state of the cartridge 7, for example, the types of the electrophotographic photosensitive drum 1 and the developer t in the cartridge 7, the lot number, the history of cartridge usage, the number of performed image forming operations, etc.

Another datum stored in the memory 55*b* is datum regarding the amount of the developer remaining in the developer storage portion 41, which is transmitted from the apparatus main assembly A through the electrical contacts 55*d*1 and 55*d*2 on the cartridge side. In this embodiment, a minimum of the datum regarding the amount of the remaining developer detected by the developer remainder amount detecting means is stored in the memory 55*b*. Having the data regarding the amount of the remaining developer stored in the memory 55*b* makes it possible to properly manage a cartridge 7 in terms of service life, even when the cartridge 7 is transferred from one apparatus to another during its usage.

The memory unit 55 is attached to the first frame 6 with the use of one of such means as a piece of two-sided adhesive tape, adhesive, thermal crimping, ultrasonic welding, snap fit, etc., and is precisely positioned relative to the apparatus main assembly A by the first and second cartridge positioning portions 31 (bearings) of the first frame of the cartridge 7. Therefore, the memory unit 55 attached to the first frame 6 is precisely positioned relative to the apparatus main assembly A, being thereby precisely positioned relative to the communication unit 56 of the apparatus main assembly A.

The communication unit 56 is provided with four sets of conductive electrical contacts 56*a*. Each set has two electrical contacts 56*a*, which are placed in contact with the two conductive areas 55*c*1 and 55*c*2 of the corresponding memory unit 55.

Providing each of the conductive areas 55*c*1 and 55*c*2 with two electrical contacts, in other words, providing the conductive area 55*c*1 with two first electrical contacts 55*d*1, and the conductive area 55*c*2 with two second electrical contacts 55*d*2, as described before, improves communication reliability. In reality, the first and second electrical contacts 55*d*1 and 55*d*2 mean nothing but the scratch marks which the electrical contacts 56*a* on the apparatus main assembly side make on the conductive areas (55*c*1 and 55*c*2) as the cartridge 7 is inserted into the apparatus main assembly A.

Figure 14:
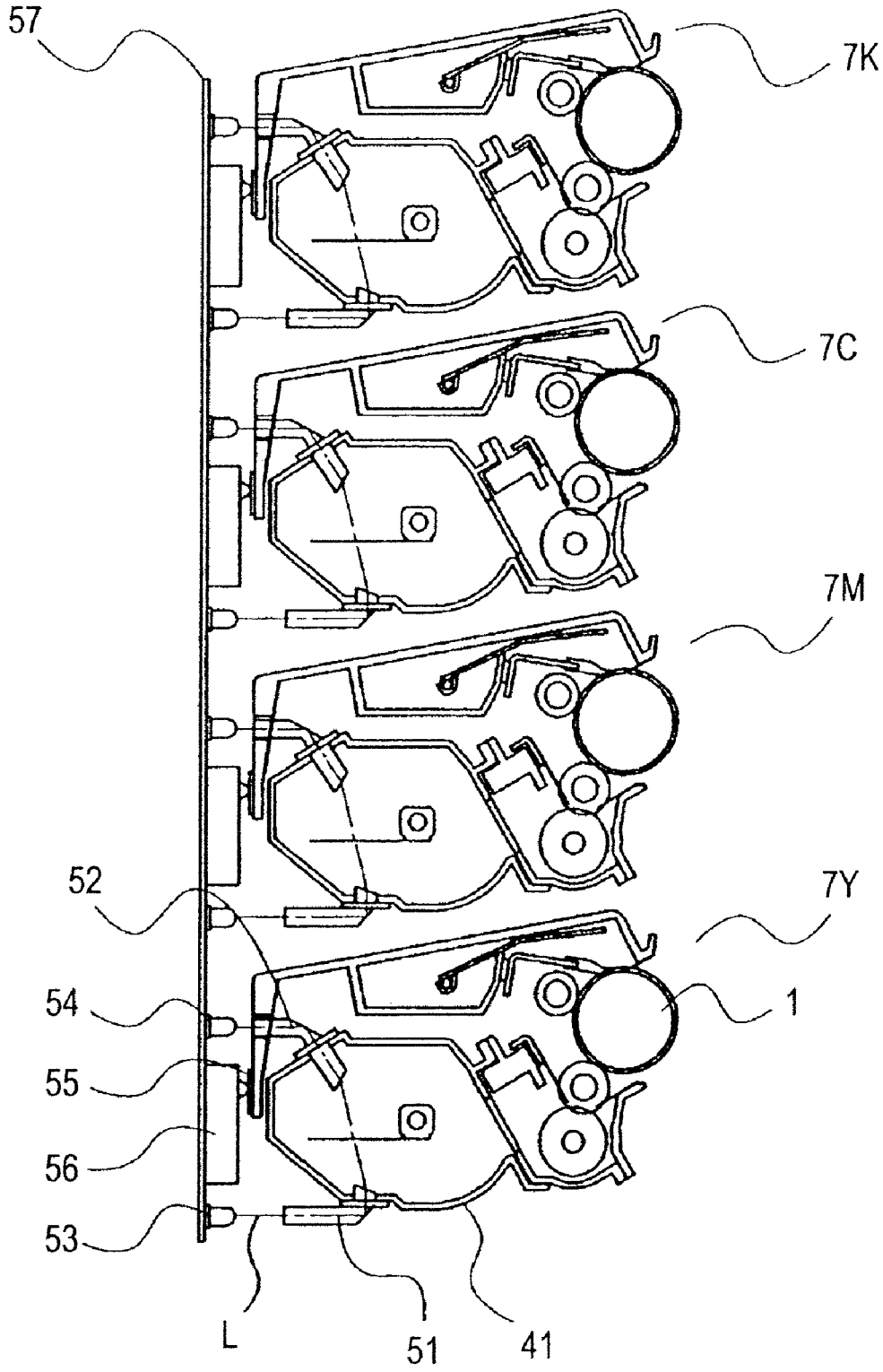
FIG. 14 is a sectional view of the process cartridges in the preferred embodiment of the present invention, and a part of an image forming apparatus in the preferred embodiment, which are holding the process cartridges.
Figure 15:
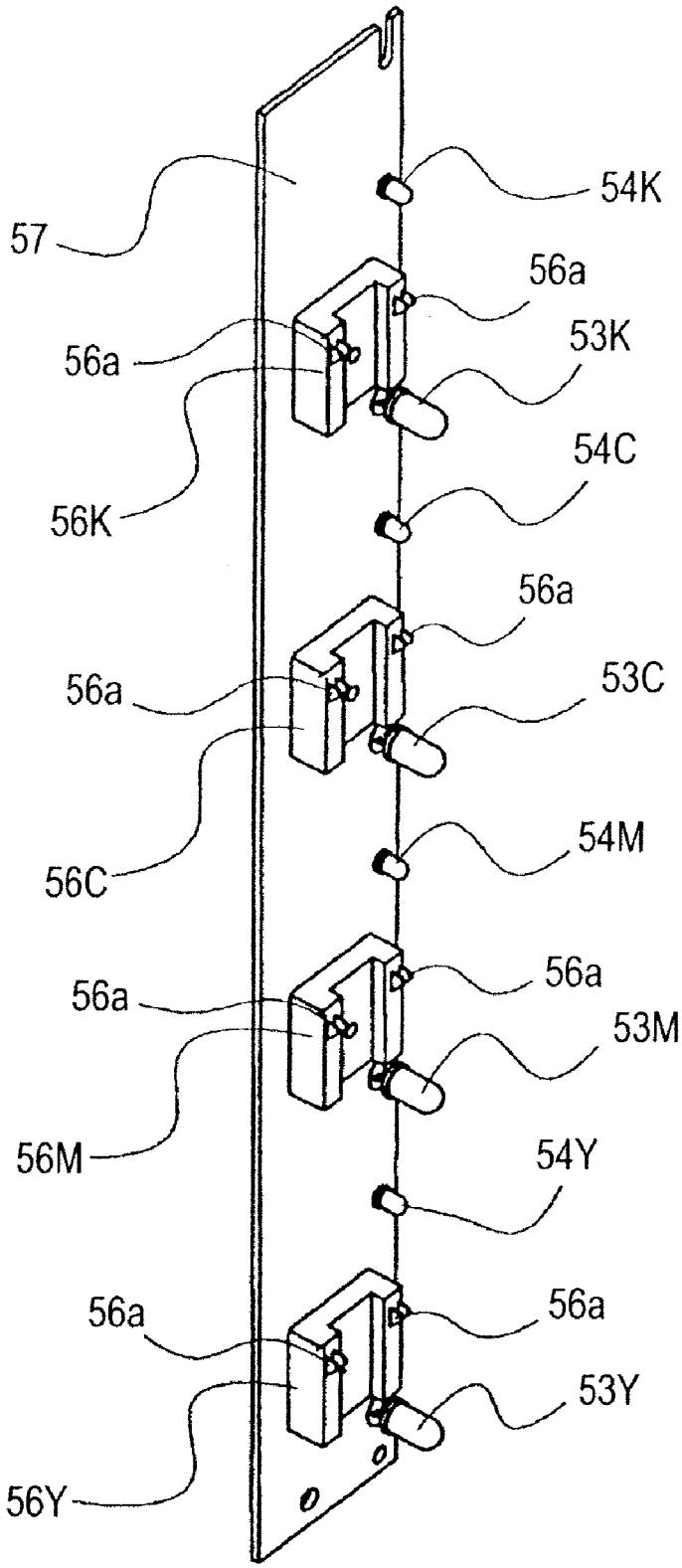
FIG. 15 is a perspective view of the beam emitting portion, the beam receiving portion, and communicating means, of an image forming apparatus in the preferred embodiment of the present invention.

Next, referring to FIGS. 14 and 15, the state of the cartridge 7 mounted in the apparatus main assembly A will be described. FIG. 14 is a schematic sectional view of the cartridge holding portion of the color image forming apparatus 100, and the cartridges 7 therein, in accordance with the present invention, showing the structures thereof. FIG. 15 is a perspective view of the dielectric substrate 57 of the apparatus main assembly A, on which the beam emitting portion 53, the beam receiving portion, and the communication unit 56*a* (electrical contacts on main assembly side) are mounted.

The image forming apparatus 100 is capable of holding four cartridges 7, which are inserted into the apparatus main assembly A, so that the photosensitive drum 1 of each cartridge 7 is located on the intermediate transferring member side, and also, so that the four cartridges 7 are vertically stacked. More specifically, the image forming apparatus 100 is provided with multiple (four) vertically stacked cartridge compartments 7*t* into which the cartridges 7Y, 7M, 7C, and 7K different in the color of the developer they store are removably mountable. The beam entrance portion 51*a* of the first beam guide 51, and the beam exit portion (surface) 52*a* of the second beam guide 52, are located at the front end of the cartridge 7 in terms of the cartridge insertion direction, as shown in FIG. 1. The beam entrance surface 51*a* and beam exit surface 52*a* are vertically spaced apart by a distance equal to the height of the developer storage portion 41, and are parallel to each other. Therefore, the space between the beam entrance surface 51*a* and beam exit surface 52*a* constitutes a dead space. In the case of the cartridge 7 in this embodiment, the memory unit 55 for communicating with the main assembly of the printer 100 is placed in this space.

Figure 16:
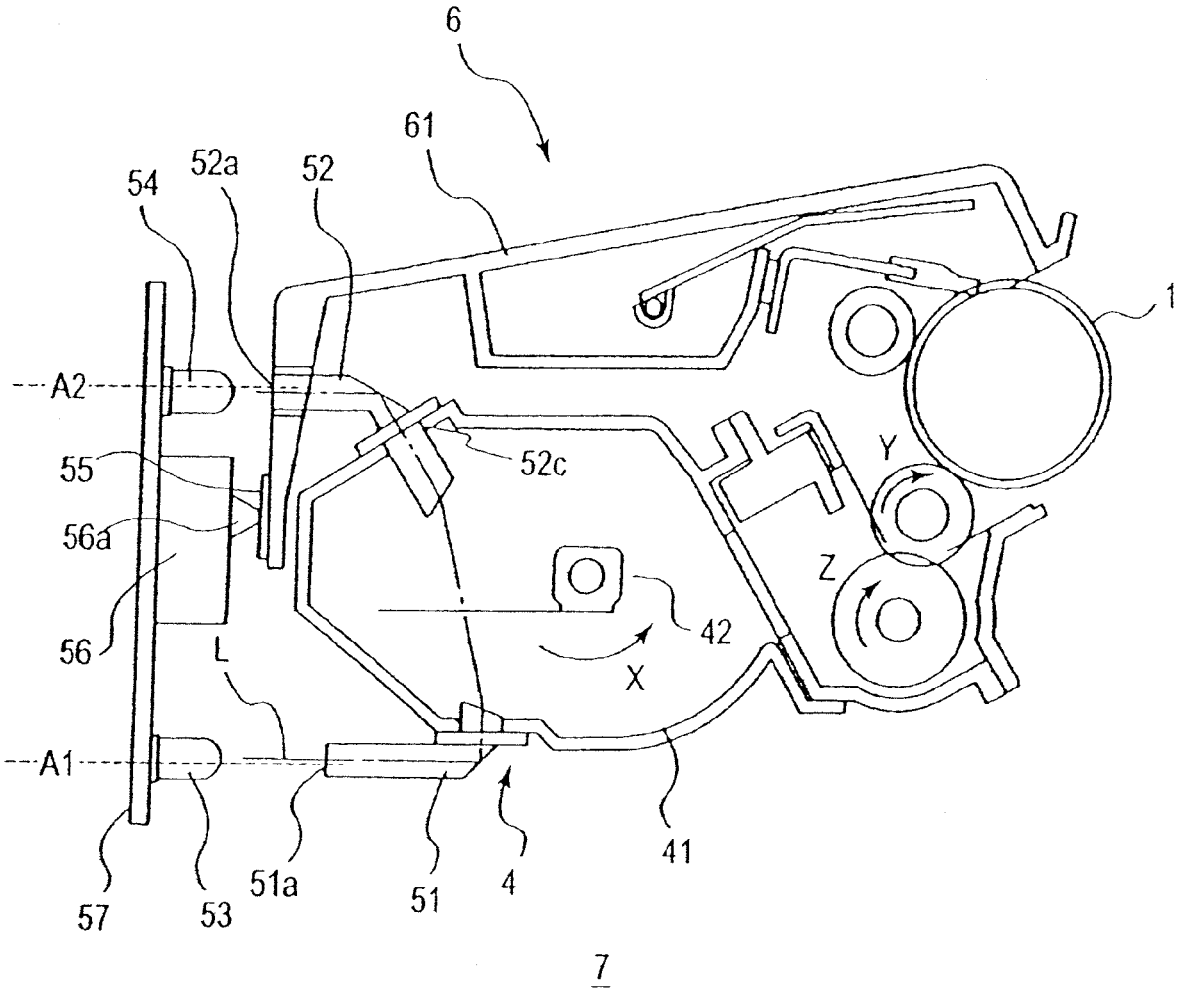
FIG. 16 is a sectional view of the process cartridge in the preferred embodiment.
Figure 17:
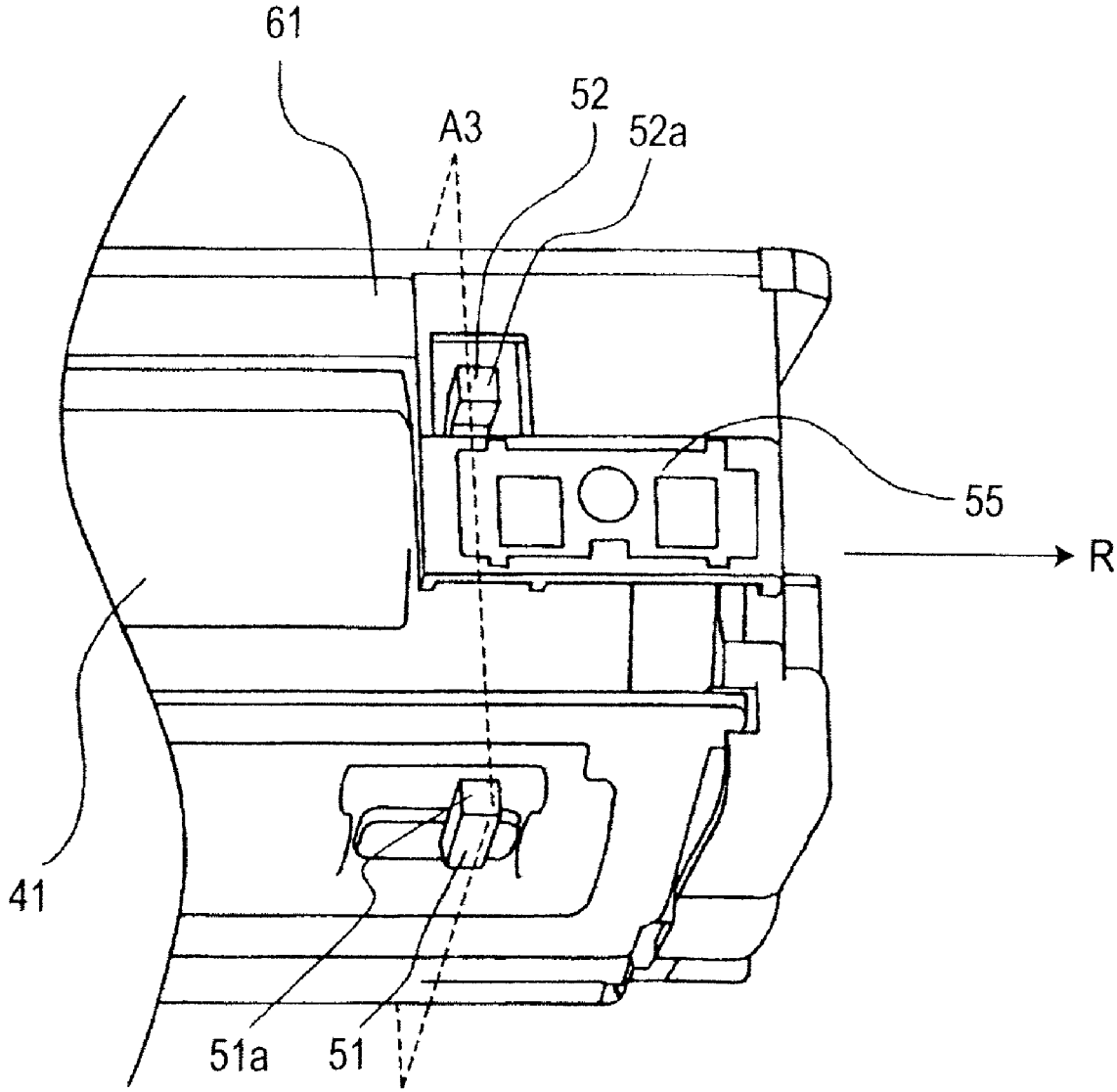
FIG. 17 shows a cartridge, illustrating arrangement of a light guide and a memory unit.

To describe these features in more detail with reference to FIG. 16, the memory unit 55 is attached to the cartridge 7 so that when the cartridge 7 is in the main assembly of the printer 100, the memory unit 55 is positioned between the horizontal plane A1 coinciding with the center of the beam entrance portion (surface) 51*a*, and the horizontal plane A2 coinciding with the center of the exist portion (surface) 52*a*. Further, referring to FIG. 17, the memory 55 is placed so that the vertical plane A3 coinciding with the centers of the beam entrance portion (surface) 51*a* and beam exit portion (surface) 52*a*, and perpendicular to the rotational axis R of the photosensitive drum 1, crosses a part of the memory unit 55.

In other words, the memory unit 55 is placed so that the beam entrance portion 51*a*, the memory unit 55, and the beam exit portion 52*a* appear vertically aligned as seen from the direction perpendicular to the drawing. Therefore, the first beam guide 55, the second beam guide 52, and the memory 55 can be compactly placed in the cartridge 7, making it possible to reduce the dimension of the cartridge 7 in terms of the direction parallel to the axial direction of the photosensitive drum 1, and therefore, making it possible to reduce the size of the printer 100 in which the cartridge 7 is removably mountable.

Further, the memory unit 55 on the printer side, the first beam guide 51, and the second beam guide 52, are placed close to each other, and the communication unit 56 is attached to the main assembly of the printer 100 so that when the cartridge 7 is in the printer 100, the communication unit 56 is placed between the horizontal plane A1 coinciding with the center of the LED 53, and the horizontal plane A2 coinciding the center of the photo-transistor 54, as shown in FIG. 16.

Therefore, the LED 53, the photo-transistor 54, and the communication unit 56 can be placed on the same substrate. Further, the means for controlling these components can also be placed on the same substrate, making it unnecessary to distribute these components and controlling units among multiple substrates, and therefore, making it possible to reduce the component count of the apparatus main assembly A as well as the size of the apparatus main assembly A.

The cartridge 7, the memory unit 55 of which is attached thereto so that the beam entrance portion 51*a*, the beam exit portion 52*a*, and the memory unit 55 of the cartridge 7 vertically align as seen from the direction perpendicular to the drawing, is preferable as the cartridge for the color printer 100 in which multiple cartridges are vertically stacked, as shown in FIG. 14.

Further, the LED 53 for detecting the amount of the remaining developer, the photo-transistor 54, the communication unit 56 as the electrical contact on the main assembly side, which are attached to the apparatus main assembly A so that they directly face the first beam guide 51, the second beam guide 52, and the memory unit 55, can be compactly disposed in a single area.

Therefore, the LED 53, the photo-transistor 54, and the communication unit 56 can be compactly placed on the same rectangular substrate 57 as shown in FIG. 15, making it possible to substantially reduce the electrical wiring and compactly place the components, contributing thereby to the reduction of the size of the printer 100 which employs multiple cartridges 7.

As described above, in this embodiment, the memory unit 55 is placed in the aforementioned dead space. More specifically, referring to FIGS. 1 and 13, the beam entrance surface 51*a* and the beam exit surface 52*a* are located at the front end of the cartridge 7 in terms of the cartridge insertion direction, and at the same location in terms of the lengthwise direction (parallel to the axial line of photosensitive drum 1). Further, the memory unit 55 is attached to the cartridge 7 so that a part of the memory unit 55 is crossed by the straight line S1 connecting the outward edges of the beam entrance portion (surface) 51*a* and the beam exit portion (surface) 52*a*. More specifically, in this embodiment, the cartridge 7 is structured so that the straight line S1 crosses the conductive area 55*c*1 of the memory unit 55.

Therefore, it is possible to make the dimension of the cartridge 7, in particular, the first frame 6, smaller, in terms of the lengthwise direction, than the dimension of a process cartridge in accordance with the prior art, the beam entrance portion 51*a* and the beam exit portion 52*a* of which are located apart from each other, in terms of the lengthwise direction, in order to prevent the developer remainder amount detection beam from interfering with the beam for forming a latent image on the peripheral surface of the photosensitive drum 1. Therefore, it is possible to reduce the overall size of the cartridge 7.

Further, the beam entrance portion 51*a*, the beam exit portion 52*a*, and the memory unit 55 are attached to the cartridge 7 so that they vertically align as they are seen from the direction perpendicular to the drawing, and also, so that they are located close to each other. Therefore, the beam emitting portion (LED) 53, the beam receiving portion (photo-transistor) 54, and the communication unit 56 for detecting the amount of the remaining developer can be attached to the main assembly of the image forming apparatus 100, employing the cartridge 7 structured as described, so that they are positioned close to each other.

Therefore, the beam emitting portion 53 (53Y, 53M, 53C, and 53K), the beam receiving portion 54 (54Y, 54M, 54C, and 54K), and the communication unit 56 (56Y, 56M, 56C, and 56K) can be placed on the same substrate 57. Further, the means for controlling these components can also be placed on the same substrate 57. Therefore, it is unnecessary to distribute the aforementioned components and controlling means among multiple substrates. Therefore, it is possible to reduce the component count and the size of the apparatus main assembly A.

Further, the beam emitting portion 53, the beam receiving portion 54, and the communication unit 56 of the color image forming apparatus 100 which employs multiple cartridges 7, the beam entrance portion 51*a*, the beam exit portion 52*a*, and the memory unit 55 of which are attached to the cartridge 7 so that they are positioned close to each other, and also, so that they appear to vertically align as seen from the direction perpendicular to the drawing (FIG. 13), and in which the multiple cartridges 7 are vertically stacked as shown in FIG. 14, can be placed on the same rectangular substrate 57 for sensors, which extends in the vertical direction (FIG. 15).

Therefore, it is unnecessary to distribute the aforementioned components and controlling means among multiple substrates, making it possible to substantially reduce wiring and compactly place them. Therefore, it is possible to reduce the component count and size of the image forming apparatus 100.

Incidentally, the cartridge 7 in this embodiment is structured so that the aforementioned line S1 crosses the conductive area 55*c*1 of the memory unit 55. The line S1, however, may cross any part of the memory unit 55 as long as it crosses the memory unit 55. Even if the line S1 crosses a portion of the memory unit 55 different from the portion which the line S1 crosses in this embodiment, the effects of the present invention are the same as those described above.

Further, in this embodiment, the electrical contacts 91, 92, and 93 of the cartridge 7 are located at the same end of the cartridge 7 as the end at which the first and second beam guides 51 and 52, and the memory unit 55, are located, in terms of the lengthwise direction (parallel to axial line of photosensitive drum 1), as shown in FIG. 5. Therefore, the components of the apparatus main assembly A and the cartridge 7, which electrically connect the apparatus main assembly A and cartridge 7, can be compactly placed, making it possible to shorten the wiring between the power source (unshown) and electrical substrates of the apparatus main assembly A.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application Nos. 349466/2003, 398939/2003 and 161219/2004, filed Oct. 8, 2003, filed Nov. 28, 2003 filed May 31, 2004, which are hereby incorporated by reference.

What is claimed is:

1. A process cartridge detachably mountable to a main assembly of an electrophotographic image forming apparatus, the electrophotographic image forming apparatus including a light emitting portion and a light receiving portion, said process cartridge comprising:

an electrophotographic photosensitive drum;

a developing member configured and positioned to develop an electrostatic latent image formed on the electrophotographic photosensitive drum;

a driving force receiving portion configured and positioned to receive a driving force from the main assembly of the image forming apparatus when said process cartridge is mounted to the main assembly of the image forming apparatus;

a cartridge frame comprising:

a first frame configured and positioned to support said electrophotographic photosensitive drum;

a second frame rotatably connected with said first frame and supporting said developing member, said second frame further having a developer accommodating portion configured to accommodate a developer to be used for development of an electrostatic latent image by said developing member;

a memory member provided in said first frame;

a cartridge electrical contact disposed at such a position as is adjacent one end of said cartridge frame with respect to the direction of an axis of said electrophotographic photosensitive drum and as is adjacent a leading end of said cartridge frame with respect to a mounting direction in which said process cartridge is mounted to the main assembly of the apparatus, said cartridge electrical contact being contactable with a main assembly electrical contact provided in the main assembly of the image forming apparatus to transmit information stored in said memory member to the main assembly of the image forming apparatus when said process cartridge is mounted to the main assembly of the image forming apparatus;

a light entrance portion of a first light guide, said light entrance portion being disposed at such a position as is adjacent said one end and as is adjacent the leading end of said cartridge frame, said light entrance portion being opposed to said emitting portion when said process cartridge is mounted to the main assembly of the image forming apparatus;

a light exit portion of a second light guide, said light exit portion being disposed at such a position as is adjacent said one end and as is adjacent the leading end of said cartridge frame, and said light exit portion being opposed to said light receiving portion when said process cartridge is mounted to the main assembly of the image forming apparatus;

a first cartridge positioning portion, disposed at such a position as is adjacent said one end, configured and positioned to engage with a first main assembly positioning portion provided in the main assembly of the image forming apparatus to position said process cartridge relative to the main assembly of the image forming apparatus when said process cartridge is mounted to the main assembly of the image forming apparatus;

a second cartridge positioning portion, disposed at such a position as is opposite said one end, configured and positioned to engage with a second main assembly positioning portion provided in the main assembly of the image forming apparatus to position said process cartridge relative to the main assembly of the image forming apparatus when said process cartridge is mounted to the main assembly of the image forming apparatus; and a cartridge limiting portion configured and positioned to abut a regulating portion of the main assembly provided in the main assembly of the image forming apparatus to limit rotation of said process cartridge which otherwise would occur about said first cartridge positioning portion and said second cartridge positioning portion when said driving force receiving portion receives a driving force from the main assembly of the image forming apparatus.

2. An apparatus according to claim 1, wherein when said process cartridge is mounted to the main assembly of the image forming apparatus, said first frame takes a relatively higher position than said second frame, said first light guide takes a position below said developer accommodating portion to guide the light emitted from the emitting portion into said developer accommodating portion through said light entrance portion, and said second light guide takes a position above said developer accommodating portion to guide the light passed through inside of said developer accommodating portion to the light receiving portion through said light exit portion.

3. A process cartridge according to claim 1, wherein said cartridge electrical contact includes a first electroconductive region having a first electrical contact and a second electroconductive region having a second electrical contact, wherein said first and second electroconductive regions and said first and second electrical contacts are provided on a common base member, wherein said first electroconductive region, said memory member and said second electroconductive region are disposed along said axis in the order named in the direction from inside to outside of said process cartridge, and wherein a line connecting an outer end of said light entrance portion and an outer end of said light exit portion, which are disposed outside of said second frame with respect to the axial direction of said electrophotographic photosensitive drum, crosses at least said base member.

4. A process cartridge according to claim 3, wherein said first electrical contact is provided at each of two positions in said first electroconductive region, and said second electrical contact is provided at each of two positions in said second electroconductive region.

5. A process cartridge according to claim 1, wherein said second light guide is projected beyond said first light guide with respect to the mounting direction of said process cartridge, and said light exit portion is disposed closer to the leading end side of said cartridge frame with respect to the mounting direction of said process cartridge than said light entrance portion, as seen from an end of said second frame with respect to a direction of the axis of said electrophotographic photosensitive drum.

6. A process cartridge according to claim 1, wherein said first frame is provided with a charging member configured and positioned to electrically charge said electrophotographic photosensitive drum; and wherein a side surface of said first frame is provided, at one end with respect to an axis direction of said electrophotographic photosensitive drum, with a charging electrical contact configured and positioned to receive a voltage to be supplied to said charging member from the main assembly of the image forming apparatus.

7. A process cartridge according to claim 1, wherein said second frame is provided with a developing roller which is said developing member, a developing blade configured and positioned to regulate the amount of the developer deposited on a peripheral surface of said developing roller, and a developer supply roller configured and positioned to supply the developer onto the peripheral surface of said developing roller; and wherein a side surface of said second frame is provided at one end with respect to a direction of the axis of said electrophotographic photosensitive drum and includes:

a blade electrical contact configured and positioned to receive a voltage to be supplied to said developing blade from the main assembly of the image forming apparatus when said process cartridge is mounted to the main assembly of the image forming apparatus; and a development electrical contact configured and positioned to receive a voltage to be supplied to said developing roller and said developer supply roller from the main assembly of the image forming apparatus when said process cartridge is mounted to the main assembly of the image forming apparatus.

8. A process cartridge according to claim 1, wherein the information is transmitted from the main assembly of the image forming apparatus through said cartridge electrical contact and is related to the amount of the developer accommodated in said developer accommodating portion.

9. An electrophotographic image forming apparatus for forming an image on a recording material, to which apparatus a process cartridge is detachably mountable, said apparatus comprising:

(i) an emitting portion;

(ii) a light receiving portion;

(iii) a main assembly electrical contact;

(iv) a base member having said emitting portion, light receiving portion and said main assembly electrical contact;

(v) mounting portion configured and positioned to mount the process cartridge, the process cartridge including, an electrophotographic photosensitive drum, a developing member configured and positioned to develop an electrostatic latent image formed on the electrophotographic photosensitive drum, a driving force receiving portion configured and positioned to receive a driving force from the main assembly of said image forming apparatus when the process cartridge is mounted to the main assembly of said image forming apparatus, a cartridge frame comprising first and second frames, the first frame being configured and positioned to support the electrophotographic photosensitive drum and the second frame being rotatably connected with the first frame and supporting the developing member, and the second frame further having a developer accommodating portion configured to accommodate a developer to be used for development of an electrostatic latent image by the developing member, a memory member provided in the first frame, a cartridge electrical contact disposed at such a position as is adjacent one end of the cartridge frame with respect to direction of an axis of the electrophotographic photosensitive drum and as is adjacent a leading end of the cartridge frame with respect to a mounting direction in which the process cartridge is mounted to the main assembly of said apparatus, the cartridge electrical contact being contactable with said main assembly electrical contact provided in the main assembly of said image forming apparatus to transmit information stored in the memory member to the main assembly of said image forming apparatus when the process cartridge is mounted to the main assembly of said image forming apparatus, a light entrance portion of a first light guide, the light entrance portion being disposed at such a position as is adjacent the one end and as is adjacent the leading end of the cartridge frame, and the light entrance portion being opposed to said emitting portion when the process cartridge is mounted to the main assembly of said image forming apparatus, a light exit portion of a second light guide, the light exit portion being disposed at such a position as is adjacent the one end and as is adjacent the leading end, and the light exit portion being opposed to said light receiving portion when the process cartridge is mounted to the main assembly of said image forming apparatus, a first cartridge positioning portion, disposed at such a position as is adjacent the one end, configured and positioned to engage a first main assembly positioning portion provision in the main assembly of said image forming apparatus to position the process cartridge relative to the main assembly of said image forming apparatus when the process cartridge is mounted to the main assembly of said image forming apparatus, a second cartridge positioning portion, disposed at such a position as is opposite the one end, configured and positioned to engage a second main assembly positioning portion provided in the main assembly of said image forming apparatus to position the process cartridge relative to the main assembly of said image forming apparatus when said process cartridge is mounted to the main assembly of said image forming apparatus, and a cartridge limiting portion configured and positioned to abut a regulating portion of the main assembly provided in the main assembly of said image forming apparatus to limit rotation of the process cartridge which otherwise would occur about the first cartridge positioning portion and the second cartridge positioning portion when the driving force receiving portion receives a driving force from the main assembly of said image forming apparatus; and (vi) feeding means for feeding the recording material.

10. An apparatus according to claim 9, further comprising a plurality of said mounting portions configured and positioned to mount a plurality of the process cartridges containing different color developers, said cartridge mounting portions being arranged in a substantially vertical direction.

* * * * *

UNITED STATES PATENT AND TRADEMARK OFFICE

CERTIFICATE OF CORRECTION

PATENT NO. : 7,346,293 B2
APPLICATION NO. : 11/566878
DATED : March 18, 2008
INVENTOR(S) : Tatsuya Suzuki et al.

It is certified that error appears in the above-identified patent and that said Letters Patent is hereby corrected as shown below:

COLUMN 3
Line 47, “enable” should read --enabled--.

COLUMN 5
Line 9, “Description” should read --General Description--.

COLUMN 16
Line 65, “51 a” should read --51a--.

COLUMN 17
Line 64, “55c 1” should read --55c1--.

COLUMN 24
Line 18, after “said”, the right margin should be closed up.

Signed and Sealed this

Tenth Day of February, 2009

JOHN DOLL
*Acting Director of the United States Patent and Trademark Office*